US010926918B2

(12) United States Patent
White et al.

(10) Patent No.: US 10,926,918 B2
(45) Date of Patent: Feb. 23, 2021

(54) REINFORCED PLASTIC PALLET

(71) Applicant: PLÁSTICOS TÉCNICOS MEXICANOS, S.A. DE C.V., San Juan del Rio Querétaro (MX)

(72) Inventors: Marshall Spencer White, Blacksburg, VA (US); Jose Ricardo Peña Zapata, El Marquez (MX); Juan Pedro Baca Sänchez, San Juan del Río (MX); Alejandro Gómez Caudillo, San Juan del Río (MX)

(73) Assignee: Plásticos Técnicos Mexicanos, S.A. DE C.V., San Juan del Río Querétaro (MX)

( * ) Notice: Subject to any disclaimer, the term of this patent is extended or adjusted under 35 U.S.C. 154(b) by 0 days.

(21) Appl. No.: 16/333,761

(22) PCT Filed: Sep. 15, 2016

(86) PCT No.: PCT/IB2016/001326
§ 371 (c)(1),
(2) Date: Mar. 15, 2019

(87) PCT Pub. No.: WO2018/051155
PCT Pub. Date: Mar. 22, 2018

(65) Prior Publication Data

US 2019/0359378 A1 Nov. 28, 2019

(51) Int. Cl.
*B65D 19/00* (2006.01)
*B65D 19/38* (2006.01)

(52) U.S. Cl.
CPC ..... *B65D 19/0073* (2013.01); *B65D 19/38* (2013.01); *B65D 2519/00034* (2013.01);
(Continued)

(58) Field of Classification Search
CPC ..... B65D 19/38; B65D 2519/00034; B65D 2519/00069; B65D 2519/00243
(Continued)

(56) References Cited

U.S. PATENT DOCUMENTS 3,719,157 A * 3/1973 Arcocha ..... B65D 19/004 108/57.25
4,183,491 A 1/1980 Sanders
(Continued)

FOREIGN PATENT DOCUMENTS

| | | |
|---|---|---|
| JP | 2000-52432 | 9/2001 |
| MX | 2013-009602 | 5/2014 |
| WO | WO2018/051155 | 3/2018 |

OTHER PUBLICATIONS

International Preliminary Report on Patentability issued in application No. PCT/IB16/01326 dated Jul. 24, 2017.
(Continued)

*Primary Examiner* — Jose V Chen
(74) *Attorney, Agent, or Firm* — Knobbe, Martens, Olson & Bear LLP

(57) ABSTRACT

The present invention is to provide a plastic pallet with reinforcements with a great resistance to bending caused by the placing of mechanisms used for transport and storage thereof, such as those caused by racking load. Likewise, the present invention is to disclose a plastic pallet with reinforcements such as inserts, which support a larger load compared with the conventional pallets without substantially incrementing the total weight.

8 Claims, 29 Drawing Sheets

(52) U.S. Cl.
CPC ..... *B65D 2519/00069* (2013.01); *B65D 2519/00268* (2013.01); *B65D 2519/00412* (2013.01)

(58) Field of Classification Search
USPC ..... 108/57.25, 57.26, 901, 902
See application file for complete search history.

(56) References Cited

U.S. PATENT DOCUMENTS 4,397,246 A * 8/1983 Ishida ..... B65D 19/0012 108/55.3
4,735,154 A * 4/1988 Hemery ..... B65D 19/0012 108/56.1
5,687,652 A * 11/1997 Ruma ..... B65D 19/0012 108/57.25
5,736,221 A 4/1998 Hardigg
5,791,262 A * 8/1998 Knight ..... B65D 19/0012 108/57.25
6,250,234 B1 6/2001 Apps
6,758,148 B2 * 7/2004 Torrey ..... B65D 19/0004 108/51.11
6,807,910 B2 * 10/2004 Apps ..... B65D 19/0012 108/57.25
7,086,339 B2 * 8/2006 Apps ..... B65D 19/0012 108/57.25
8,181,580 B2 * 5/2012 Roth ..... B65D 19/0073 108/57.25
8,770,115 B2 * 7/2014 Apps ..... B65D 19/0004 108/57.25
9,452,864 B2 * 9/2016 Apps ..... B29C 45/0003
2001/0029874 A1 * 10/2001 Muirhead ..... B65D 19/0012 108/57.25
2002/0112653 A1 8/2002 Moore
2003/0061974 A1 * 4/2003 Smyers ..... B65D 19/0012 108/56.1
2003/0075082 A1 4/2003 Apps
2003/0110990 A1 * 6/2003 Apps ..... B65D 19/0016 108/57.25
2004/0134391 A1 * 7/2004 Sugihara ..... B65D 19/0012 108/57.25
2006/0201402 A1 * 9/2006 Moore, Jr. ..... B65D 19/0012 108/57.25
2007/0028814 A1 2/2007 Swistak
2008/0141912 A1 * 6/2008 Valentinsson ..... B65D 19/0014 108/57.33
2008/0236455 A1 * 10/2008 Naidu ..... B65D 19/0038 108/56.1
2009/0000527 A1 1/2009 Ficker
2009/0183655 A1 * 7/2009 Ogburn ..... B65D 19/0016 108/57.25
2009/0188412 A1 * 7/2009 Dubois ..... B65D 19/0022 108/57.25
2011/0120353 A1 5/2011 Jensen
2012/0160137 A1 6/2012 Linares
2012/0325125 A1 * 12/2012 Apps ..... B65D 19/0014 108/57.25
2013/0133557 A1 * 5/2013 Yoshinaga ..... B29C 44/128 108/57.25
2013/0220184 A1 8/2013 Apps
2014/0158025 A1 6/2014 Apps

OTHER PUBLICATIONS

International Search Report issued in application No. PCT/IB16/01326 dated Feb. 24, 2017.

* cited by examiner

FIGURE 6A
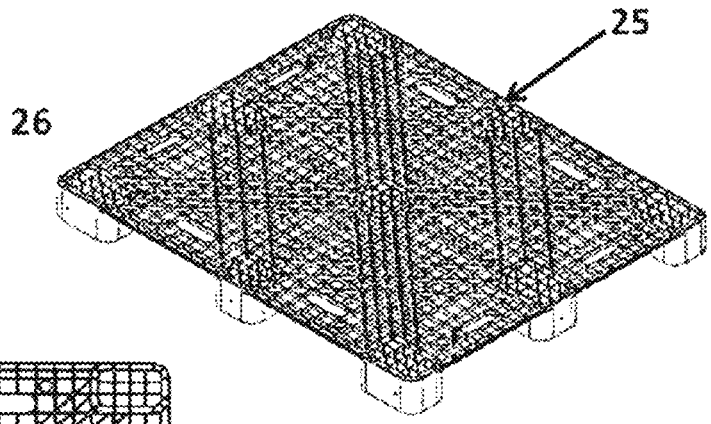
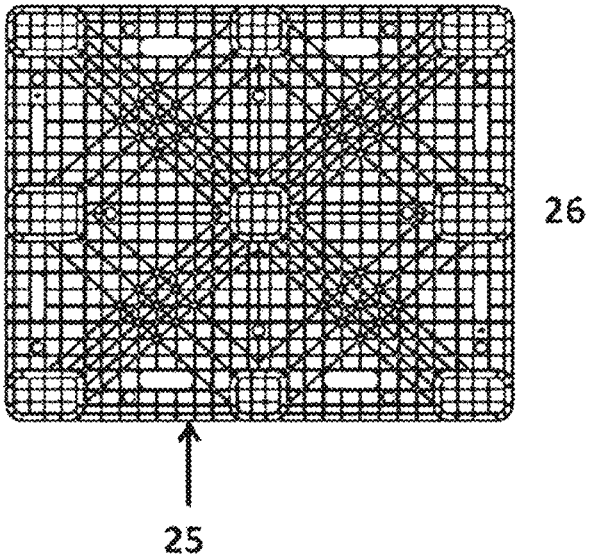
FIGURE 6B

FIGURE 7A
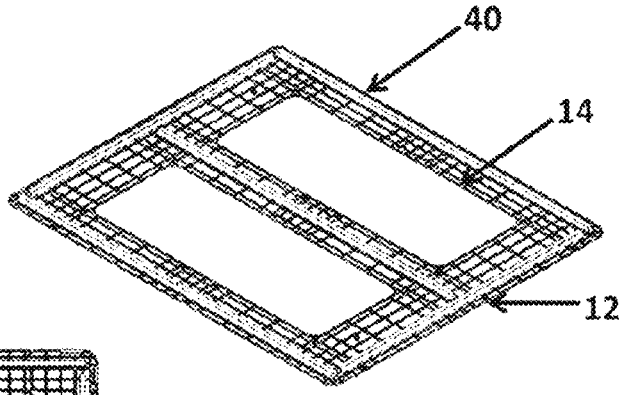
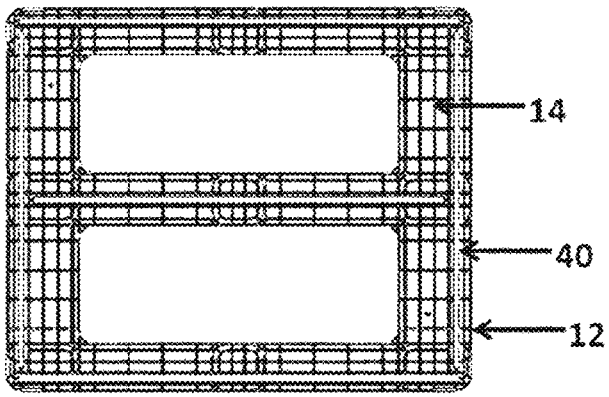
FIGURE 7B

FIGURE 10A
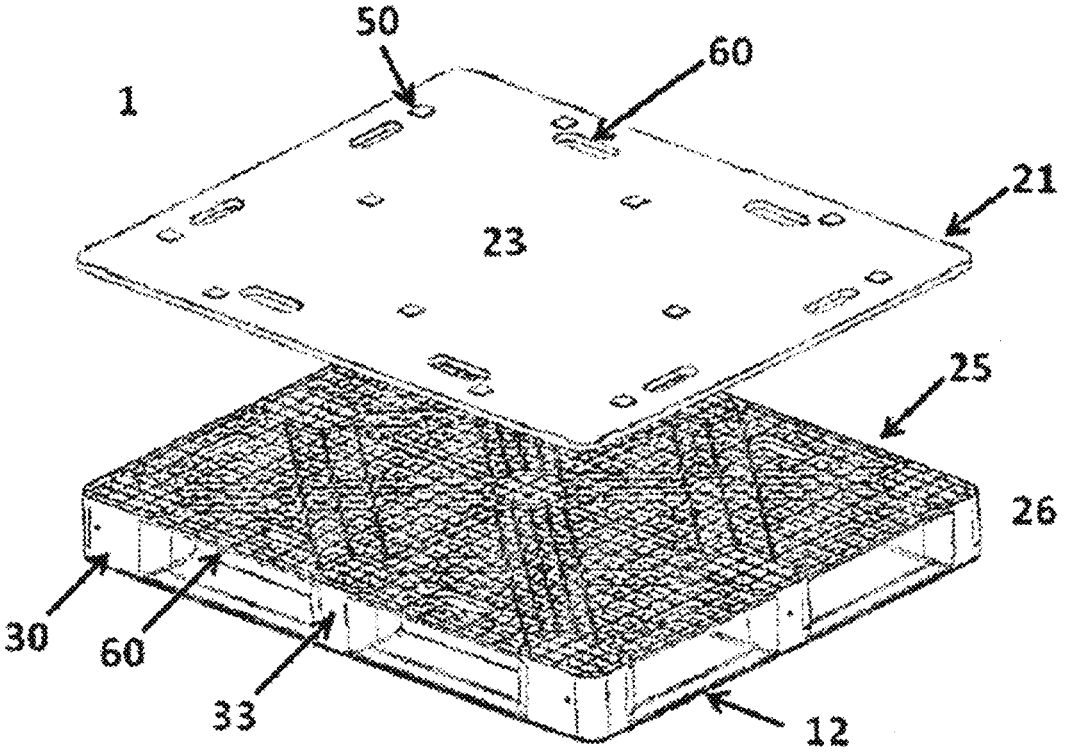
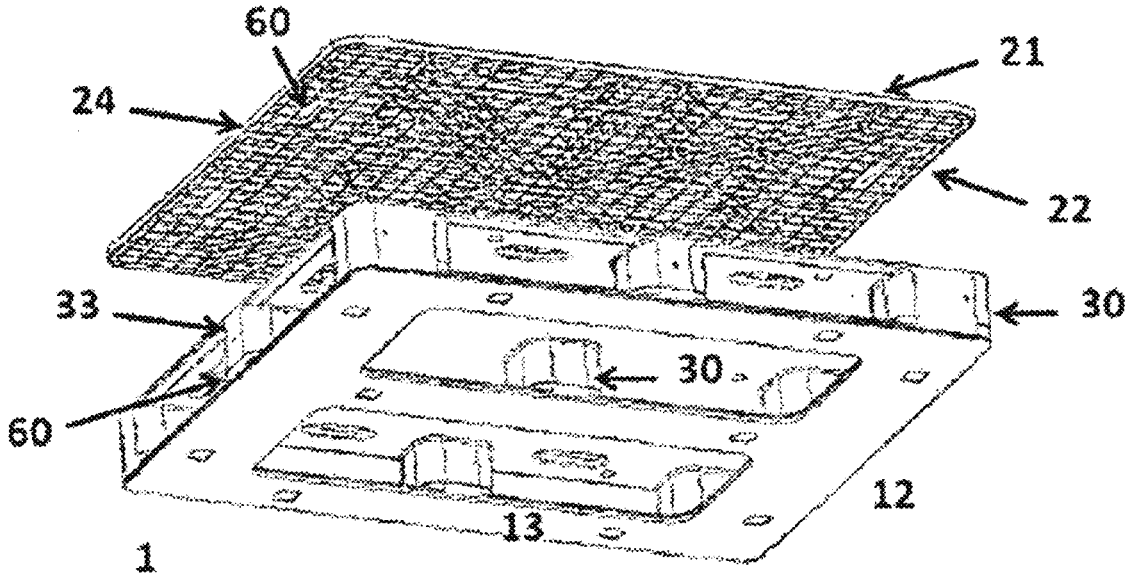
FIGURE 10B

REINFORCED PLASTIC PALLET

FIELD OF THE INVENTION

The present invention relates to plastic pallets used in the transportation of materials and goods, more specifically to reinforced plastic pallets.

BACKGROUND OF THE INVENTION

In the field of plastic pallets, there has been research and development to improve the mechanical capabilities of said pallets.

In this regard, Mexican Patent Application MX/a/2013/009602, claims a Pallet Set, wherein several elements that comprise such pallet are disclosed therein. In such pallet has a reinforcement layer which is fixed to the lower surface of the cover and is provided with several layers having a first layer having fire retardant capabilities. The first and second layers are coextruded or molded by extrusion.

Likewise, US Patent Application 2011/0120353 A1 discloses a Rackable Plastic pallet having a support reinforcement structure arranged between the center layer and the inner cover. In such document it is disclosed that "The halves of the pallets are arranged by a positioning unit which is eliminated during the welding step. The hot disc is arranged between both halves of the pallets kept by the left and right positioning supports, while the welding process is carried out.

On the other hand, in the Japanese Patent Application JP2000 052432 A a Cast Pallet Device is disclosed, wherein a device for welding halves of a pallet is disclosed, including a locating unit to position the halves of the pallet in a precise way which is removed during the welding process and the supports are placed to maintain both halves of the pallet, in position during the welding stage.

SUMMARY OF THE INVENTION

The main object of the present invention is to provide a plastic pallet with a great resistance to deformation due to different kinds of loads, such as those caused by the placing of mechanisms used for transport and storage thereof.

Likewise, another object of the present invention is to disclose a plastic pallet which can comprise reinforcements such as inserts, which support a larger load compared with the conventional pallets without substantially incrementing the total weight.

A further object of the instant invention is to provide a pallet with an inner structure of ribs and walls which provide an improved structural support to the pallet.

Another object of the invention is to provide an improved structure of ribs and walls, based in a grid arrangement, a crossed arrangement, a double-crossed arrangement or a combination thereof, in order to distribute the shear forces, the bending forces and the compression forces involved in an efficient and homogeneous way along the surfaces of the pallet.

A further object of the invention is to provide a pallet with a bottom deck and said bottom deck comprises two plane surfaces, upper and lower, arranged in a sandwich structure, wherein both surfaces are joined together by means of the aforementioned rib and walls arrangement to improve structural support of the invention.

An additional object of invention is to provide a top deck comprised by two plane surfaces upper and lower, arranged in a sandwich structure, wherein both surfaces are joined together by means of a rib arrangement to improve structural support of the invention.

Furthermore, it is an object of the invention to provide a plastic pallet having a lighter weight compared to that of the standard plastic pallet.

Another object of the invention is to provide a design such that will fit all materials handling equipment used to move, ship and store 48×40 units, as well as any other standard sizes known for the person skilled in the art.

Likewise, a further object of the invention is to provide a plastic pallet having smooth surfaces which can be cleaned easily, in order to avoid contamination of the mobilized product. This feature provides the possibility of using the instant invention under strict hygiene norms, such as those in the food or pharmaceutical industry.

BRIEF DESCRIPTION OF THE FIGURES

FIG. 6*a* shows a top frontal perspective view of the lower portion of the top deck of the instant invention illustrating the ribs and walls layout thereof.

FIG. 6*b* shows a top plain view of the lower portion of the top deck of the instant invention illustrating the ribs and walls layout thereof.

FIG. 7*a* shows a top frontal perspective view of the lower portion of the bottom deck of the instant invention illustrating the ribs and walls layout and the reinforcements beam layout thereof.

FIG. 7*b* shows a top plain view of the lower portion of the bottom deck of the instant invention illustrating the ribs and walls layout and the reinforcements beam layout thereof.

FIG. 10*a* shows a top frontal perspective view of the plastic pallet of the instant invention, removing the upper portion of the top deck.

FIG. 10*b* shows a bottom frontal view of the plastic pallet of the instant invention, removing the upper portion of the top deck.

DETAILED DESCRIPTION OF THE INVENTION

The present invention is referred to an improved plastic pallet. Such improvement is accomplished by strategically reinforcing in each of its layers and components, by means of a structure of inner ribs and walls, by providing the possibility of injecting a plastic foam in vulnerable places of the pallet and the insertion of beams of a material that is more rigid than the material of the pallet inside the components of said pallet.

In further embodiments of the instant invention, the plastic pallet can be provided without the injection of the plastic foam, which would facilitate the manufacture and lower the weight thereof.

Figure 1:
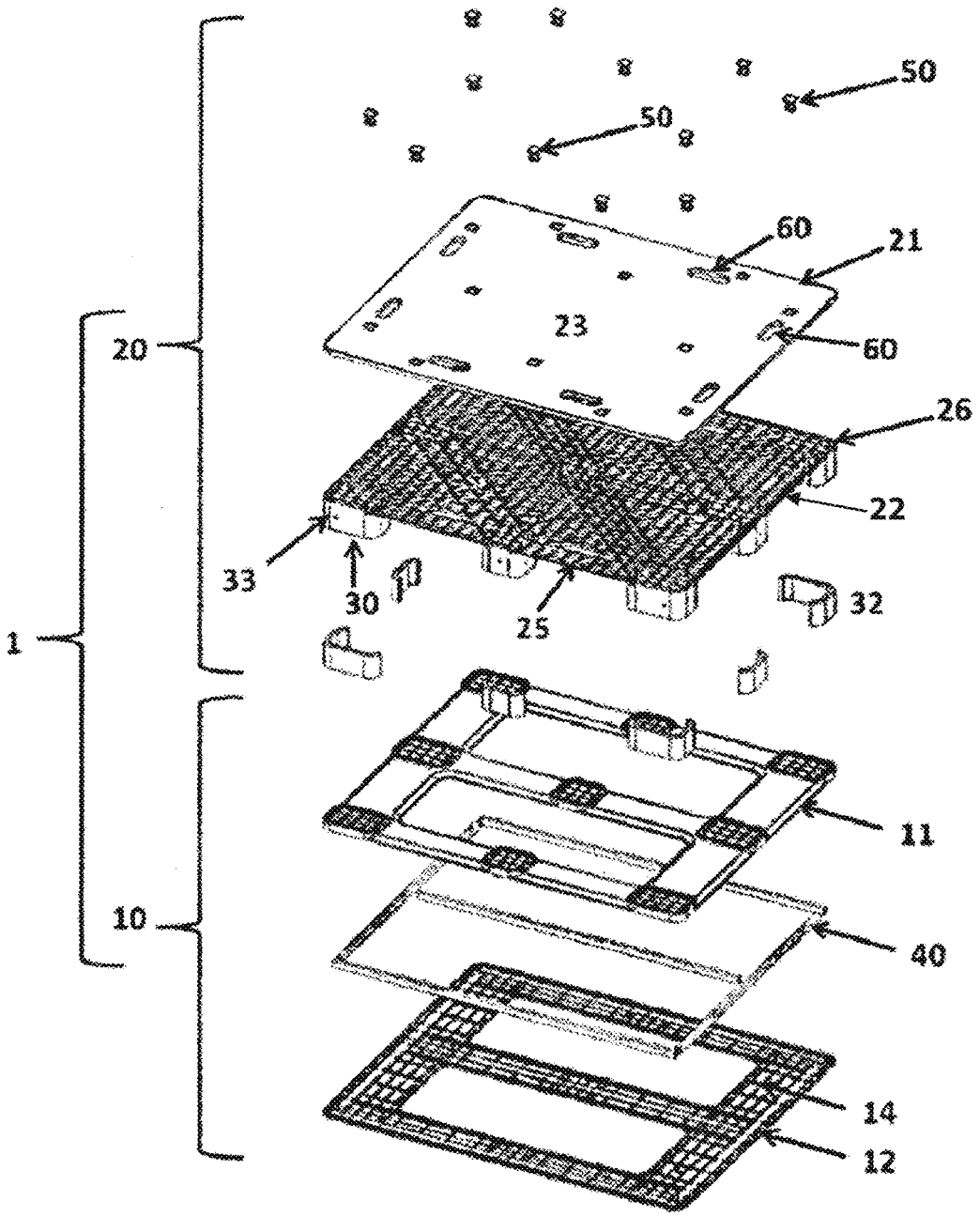
FIG. 1 shows a top frontal perspective exploded view of the instant invention, illustrating all the decks of the pallet of the instant invention.
Figure 3:
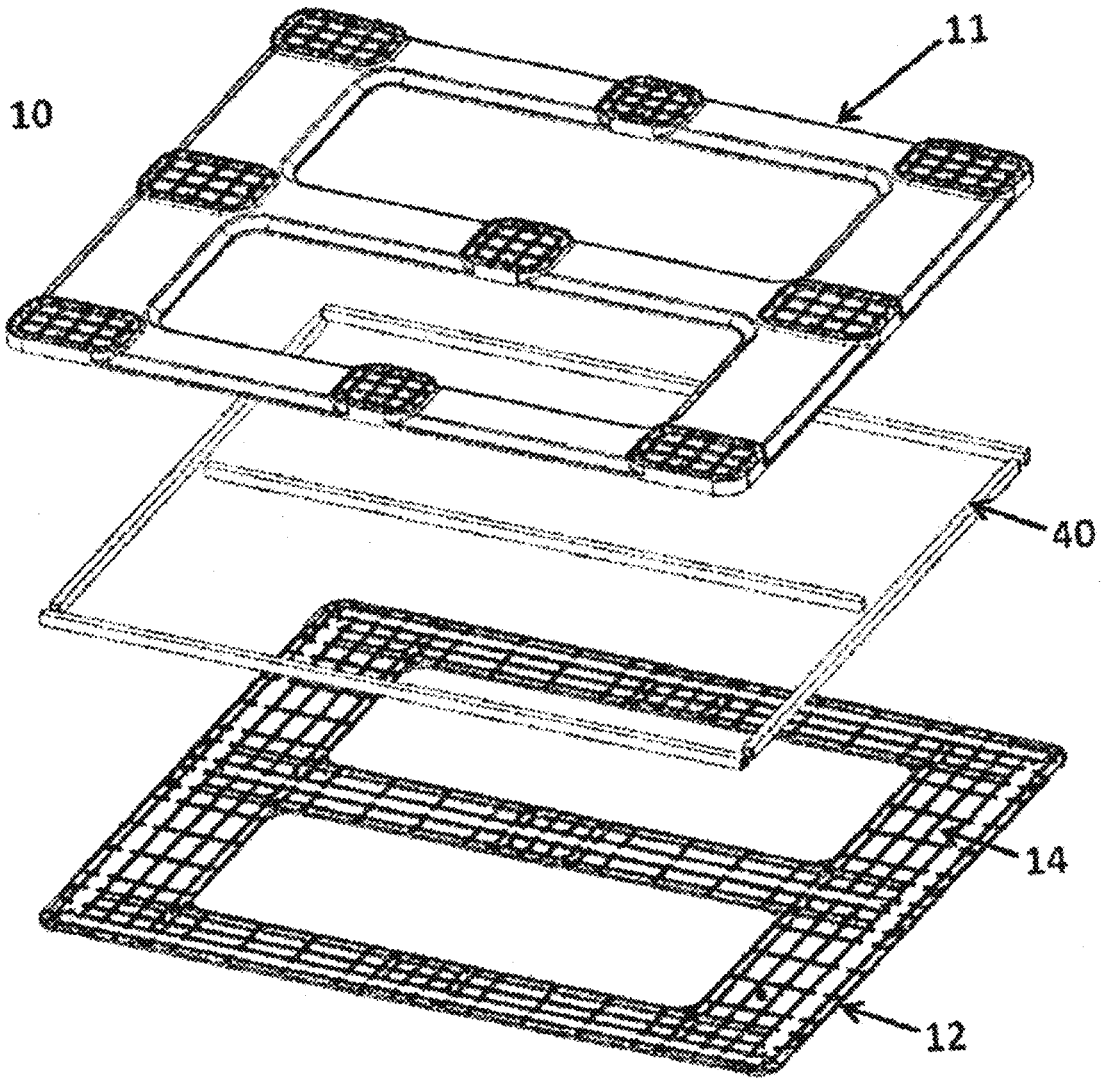
FIG. 3 shows a top frontal perspective exploded view of the bottom deck of the instant invention.

As shown in FIG. 1, in an embodiment of the invention, the improved plastic pallet (1) of the present invention is manufactured in parts which are mainly:

A bottom deck (10) shown in FIG. 3: The bottom deck (10) of the plastic pallet of the instant invention is comprised of two molded pieces (11, 12).

The bottom most part of said bottom deck (10) is the lower portion (12) of said bottom deck, which works as a bottom deck cover, said lower portion (12) comprises a smooth surface (13) at the bottom most part of the lower portion, such smooth surface (13) will serve as a base for the plastic pallet (1). On the upper side of said lower, portion (12), it is provided an arrangement of ribs and walls (14) which work as support for the bottom deck (10).

The upper portion of the bottom deck (11) also has a corresponding arrangement of ribs and walls (15) that together with the bottom deck cover will provide support for the bottom portion.

The upper portion of the bottom deck (11) and the lower portion (12) are welded together. Alternatively, both pieces are joined together using staples or any other mean for fixation available for the person skilled in the art.

Figure 2:
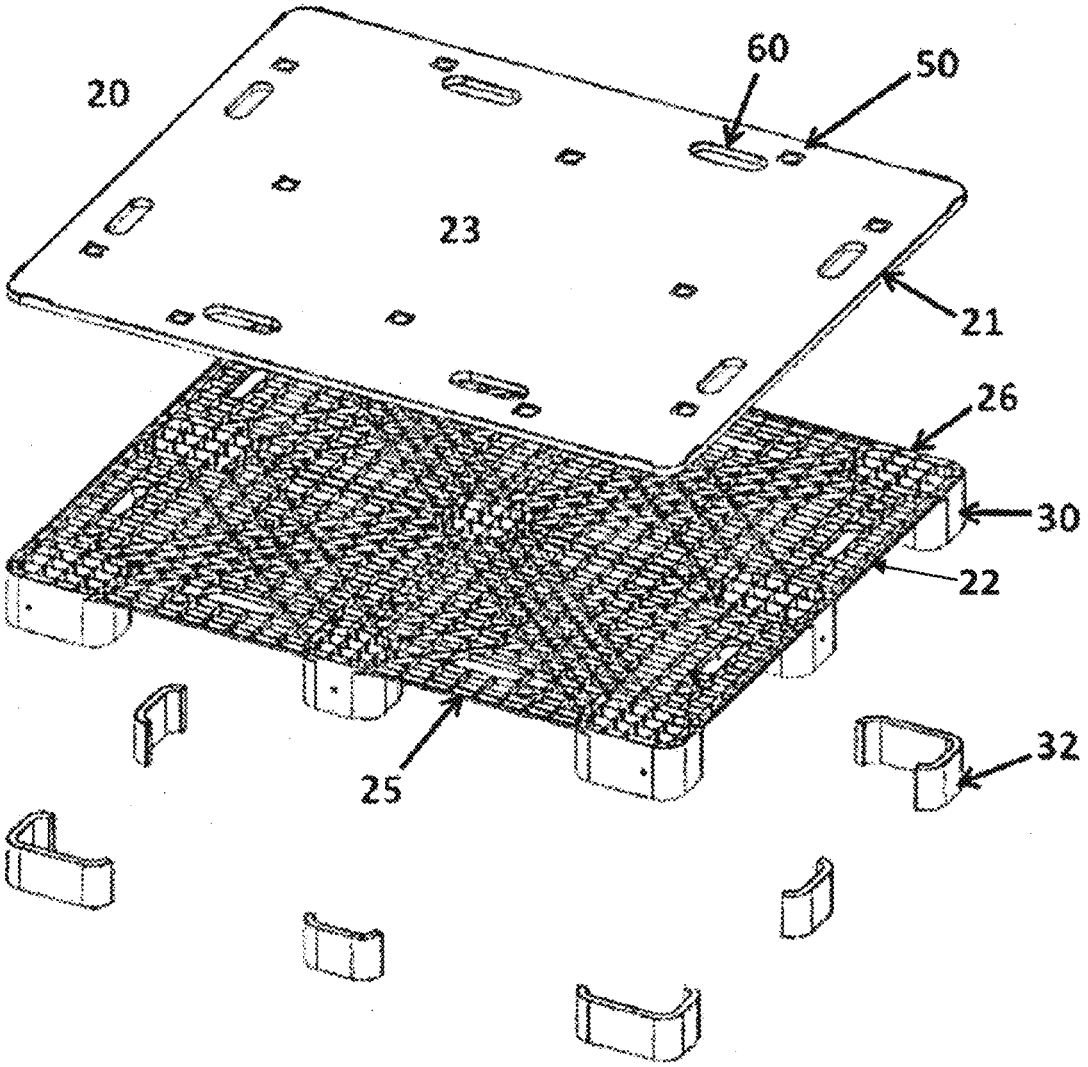
FIG. 2 shows a top frontal perspective exploded view of the top deck of the instant invention.

A top deck (20) shown in FIG. 2: the top deck (20) of the plastic pallet (1) is comprised of two molded pieces (21, 22).

As shown in FIGS. 1 and 2, the upper most part of said top deck (20) is an upper portion (21) of the top deck, which works as a top deck cover, the uppermost side (23) of such upper portion (21) provides a smooth surface for supporting the load of the pallet. The lower side of said upper portion (21) has an arrangement of ribs and walls (24) which provide support for the top deck (20).

As shown in FIG. 2, the lower part of said top deck (20) is the lower portion (22). Such lower portion (22) comprises an arrangement of ribs and walls (25) corresponding to that of the top deck cover. Likewise, said lower portion (22) comprises a set of post portions (30).

Figure 4:
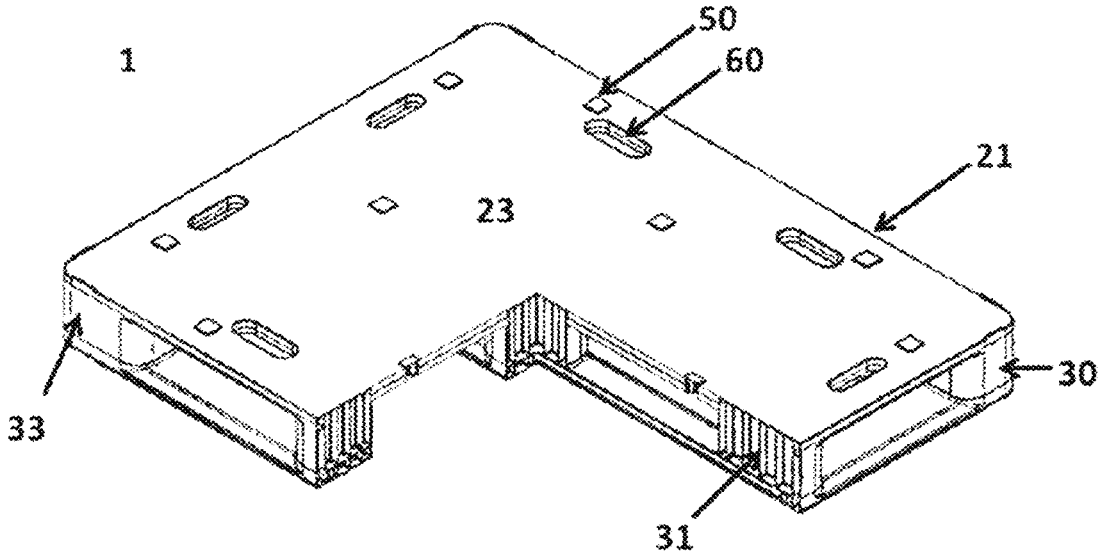
FIG. 4 shows a detailed section of the assembled pallet of the instant invention.

As shown in FIG. 4, each one of said post portions (30) forms a cavity (31) which can be injected with a plastic foam (32), according to a preferred embodiment of the instant invention. The foam will provide an improved resistance towards impact to the posts, such resistance is especially important when the pallet is engaged by a fork lift, wherein a direct impact of the forks of the fork lift could occur and consequently damage the posts (30). The injection of the plastic foam (32) considerably reduces the damage produced to the posts (30) due to the impact of the fork lift forks.

Figure 5:
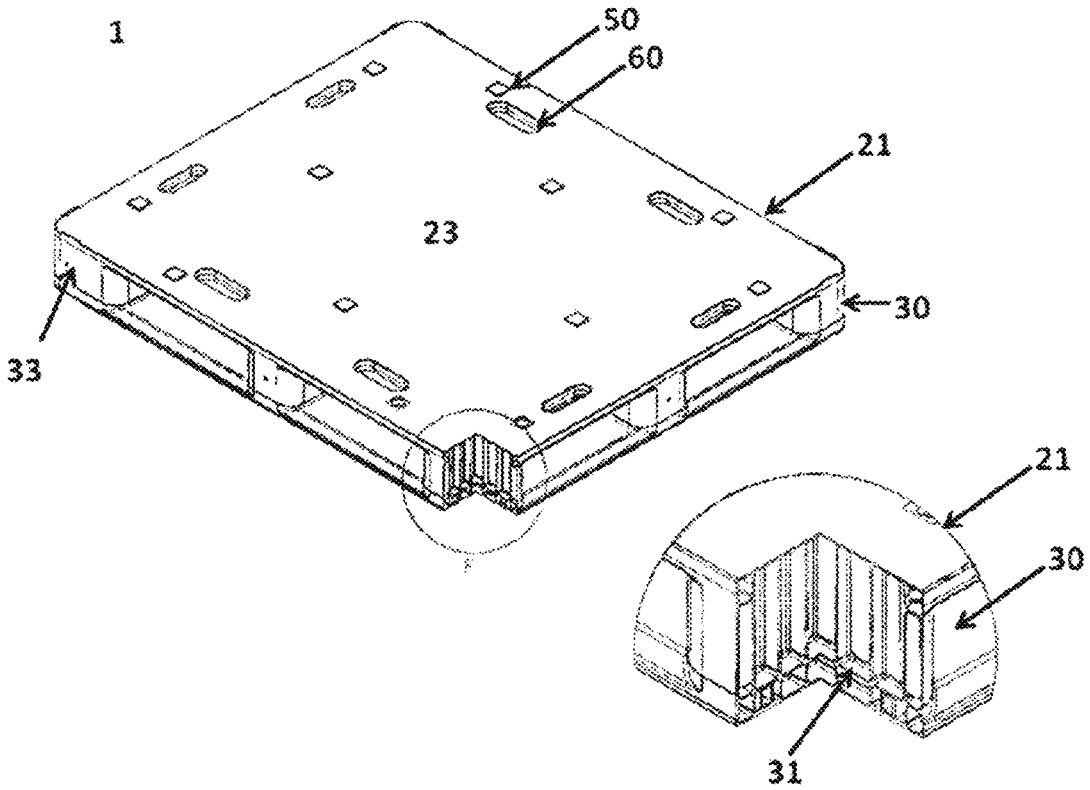
FIG. 5 shows a detailed section (F) of the post of the assembled pallet of the instant invention.

As shown in FIG. 5, according to a further embodiment of the invention, a person skilled in the art could choose from amongst many possibilities, that each one of said post portions (30) is provided with at least one injection port (33) which will receive the nozzles that will inject a plastic foam to completely fill the cavity (31) of the posts (30) to reinforce them.

Likewise, the lower portion (22) of the top deck (20) and the upper portion (21) of the top deck (20) are welded together. Alternatively, both pieces are joined together using staples or any other mean for fixation available for the person skilled in the art.

On a further embodiment of the instant invention, a set of reinforcement beams (40) is embedded between said upper portion (11) of the bottom deck (10) and said lower portion (12) of the bottom deck (10). Such reinforcement beams (40) provide strength to bending, an improved resistance towards compression and an improve rigidity of the bottom portion.

According to FIGS. 15 to 19, a preferred embodiment of the invention is shown without using reinforcements beams or inserts. Such beams or inserts can be beams of the same material of the pallet or they can be manufactured from a more rigid material. Preferably; such beams or inserts are made of a metallic material with low weight and high resistance to bending. More preferably, the beams or inserts are made of aluminum or any material with similar characteristics.

On the other hand, according to FIGS. 7*a* and 7*b*, one or a plurality of further reinforcement beams or inserts can be placed on the bottom portion of the plastic pallet.

On a further embodiment of the instant invention, shown in FIG. 3, said lower portion (12) of the bottom deck (10) and said upper portion (11) of the bottom deck (10) are two plane surfaces arranged in a sandwich structure, wherein both surfaces are joined together by means of a rib arrangement (14).

Likewise, said lower portion (22) of the top deck (20) and said upper portion (21) of the top deck (20) are two plane surfaces arranged in a sandwich structure, wherein both surfaces are joined together by means of a rib and walls arrangement (25) in the form of a grid or a double cross arrangement.

Said sandwich structure is obtained by joining two pieces with plane surfaces together by fusion (hot-plate welding) thereof through the corresponding ribs and walls (14, 25).

Welding both pieces together provides an improved rigidity or strength to flexion of the plane surfaces as a result of its connection through the welded ribs. Likewise, such arrangement distributes the shear forces, the bending forces and the compression forces along the whole surfaces, avoiding the accumulation of forces on a small surface of the pallet. This arrangement allows the material to efficiently absorb the forces minimizing the damage to the pallet assembly (1).

In order to facilitate the manufacture process, conventional pallets are provided with only an upper plane surface with ribs on its bottom part. Likewise, other conventional pallets show only ribs without plane surfaces.

An improved rigidity on the pallet surfaces reduces the damage produced to the mobilized product due to excessive deformation of the unit load during the warehouse stacking and transport operations.

In yet another embodiment of the instant invention, said rib arrangement either on the bottom deck (14) or in the top deck (25) of the pallet is a structure of walls arranged diagonally and crossing each other.

Such crossing provides strength and torsional stiffness to the areas in between, while maintaining a soft plain surface on the top portion of the top deck.

The crossed ribs are directly connected to the posts of the pallet in the top deck portion, in order to provide an improved rigidity to the area between the posts, which is the space with the larger deformations, during the transportation and manipulation of the load unit.

Such cross elements allow the instant invention to fulfill the norms regarding the limits on deformations of the pallets, during mobilization and stacking of the pallets, i.e. when the pallet is under static load. Such deformations could damage the load unit. By preventing the deformation, the damage due to deformations transmitted to the loaded product are minimized.

In another embodiment of the invention, the walls of the rib arrangement connect the pallet posts, either on the bottom, the top portion or in both portions of the plastic pallet.

Figure 14:
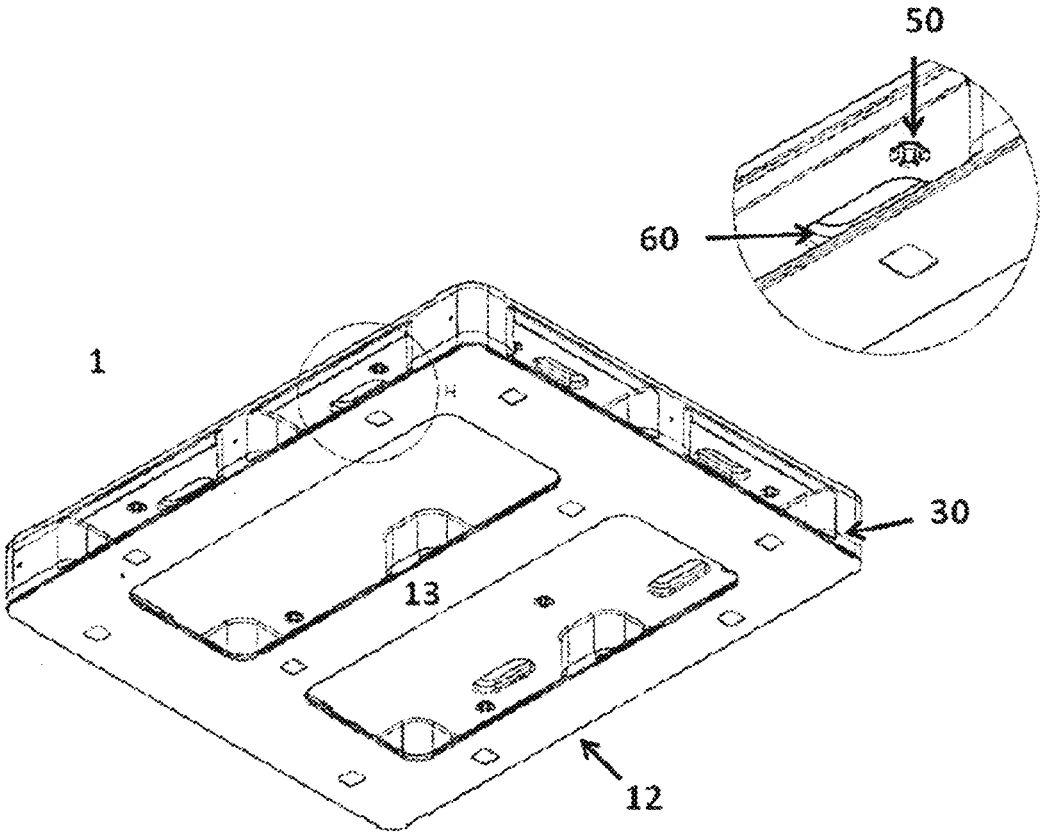
FIG. 14 shows a bottom frontal perspective view of the plastic pallet of the instant invention, illustrating a detail (H) of the assembly of the anti-slip rubbers.
Figure 15:
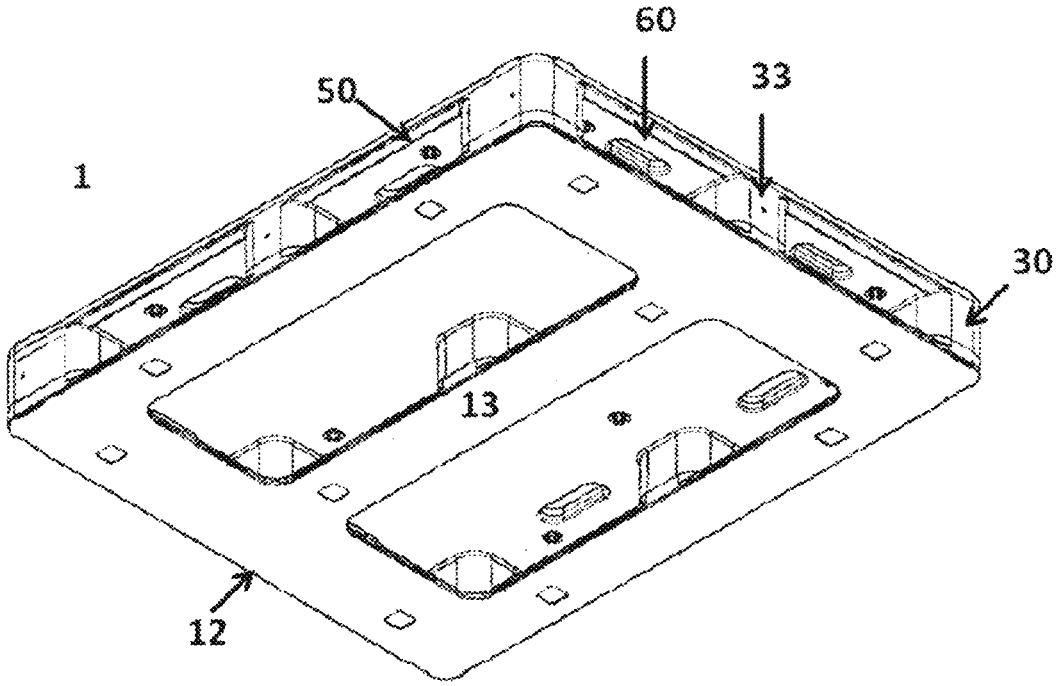
FIG. 15 shows a bottom front perspective view of the plastic pallet without reinforcements, according to a preferred embodiment of the instant invention.
Figure 16:
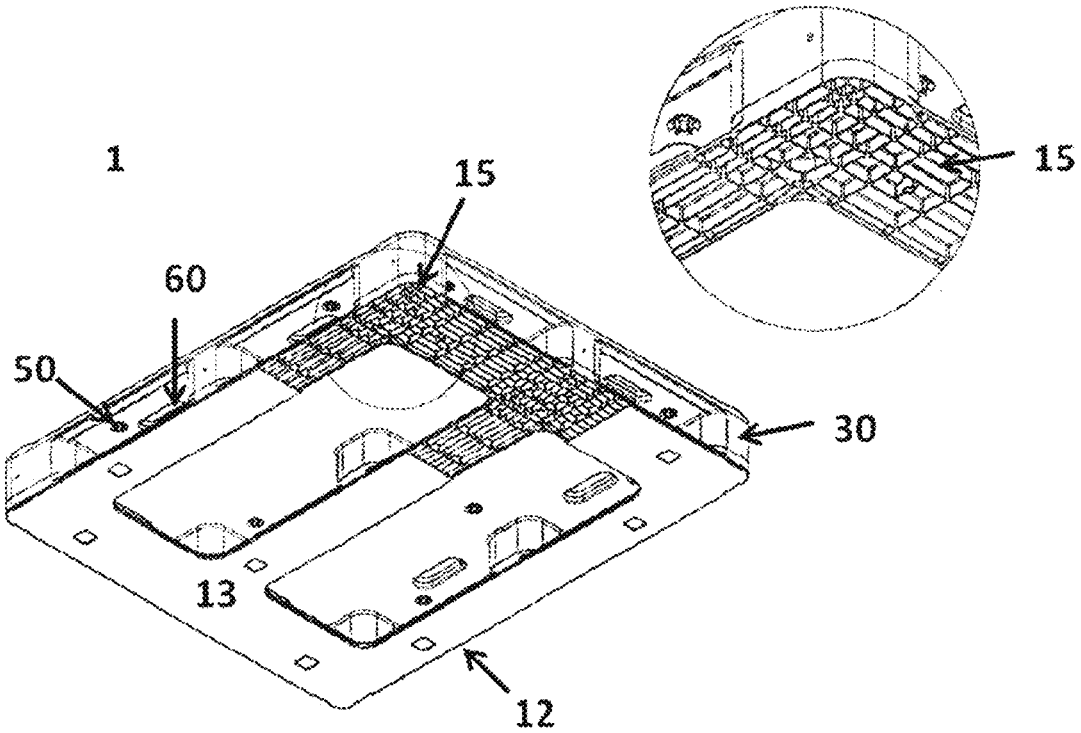
FIG. 16 shows a bottom front perspective view of the plastic pallet without reinforcements, according to a preferred embodiment of the instant invention, as well as a detail view of the upper portion of the bottom deck without reinforcements.
Figure 17:
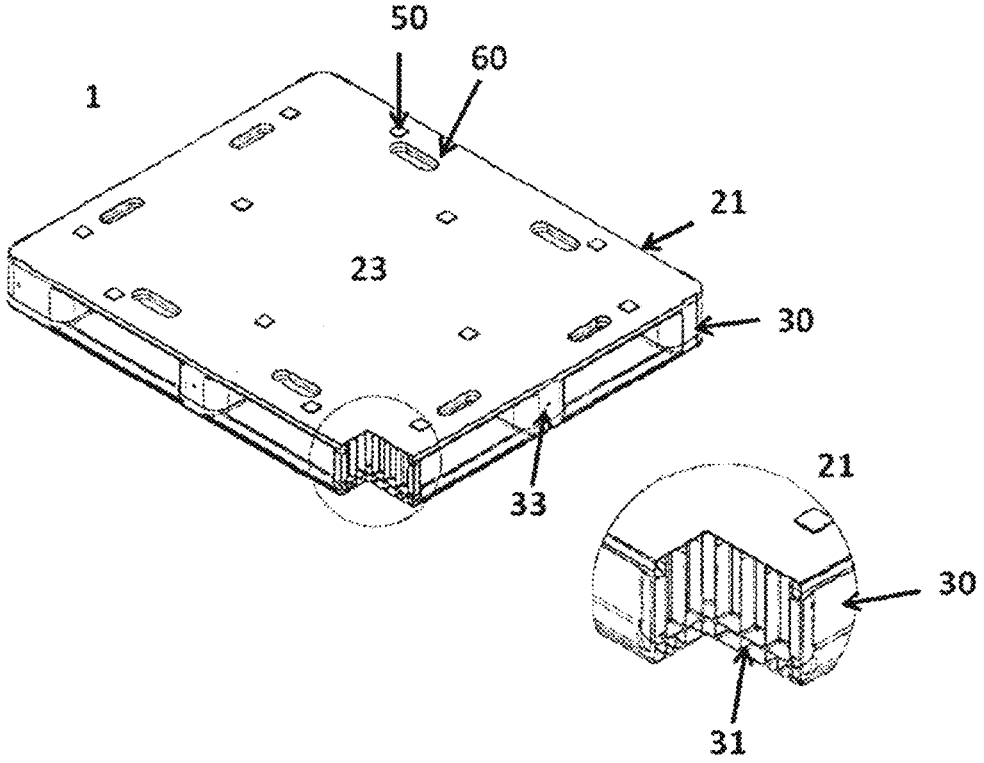
FIG. 17 shows a detailed view of the post portion of the plastic pallet without reinforcements according to an embodiment of the instant invention.
Figure 18:
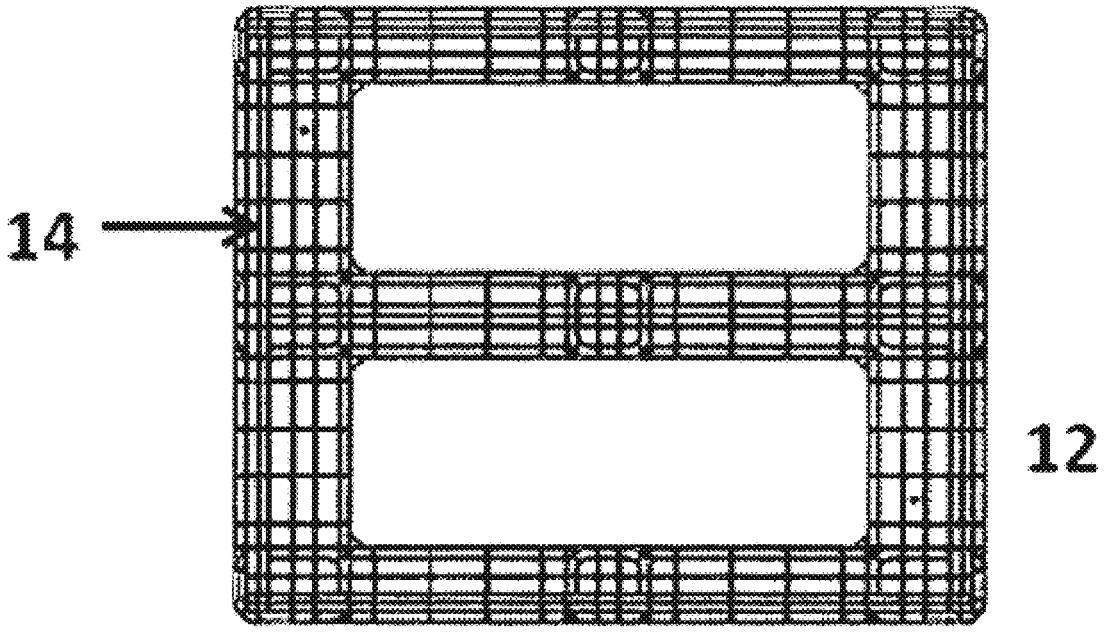
FIG. 18 shows a top plain view of the lower portion of the bottom deck without reinforcements according to a preferred embodiment of the instant invention.
Figure 19:
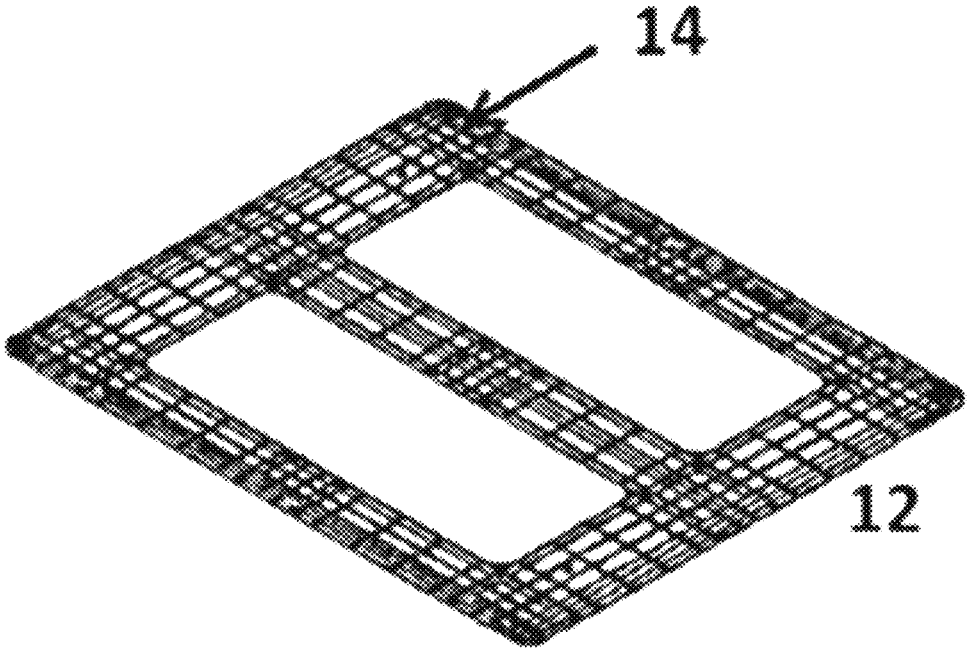
FIG. 19 shows a top side perspective view of the lower portion of the bottom deck without reinforcements according to a preferred embodiment of the instant invention.

Likewise, as shown in FIG. 14, it is possible that the top portion comprises openings for receiving anti slip rubbers (50). Such anti-slip rubbers provide a surface to avoid slipping of the merchandise loaded on the pallet.

In a further embodiment of the invention, the top portion comprises integrated handholds (60), to facilitate its handling.

In yet another embodiment, the top and bottom portions comprise smooth surfaces (61, 62).

Figure 8:
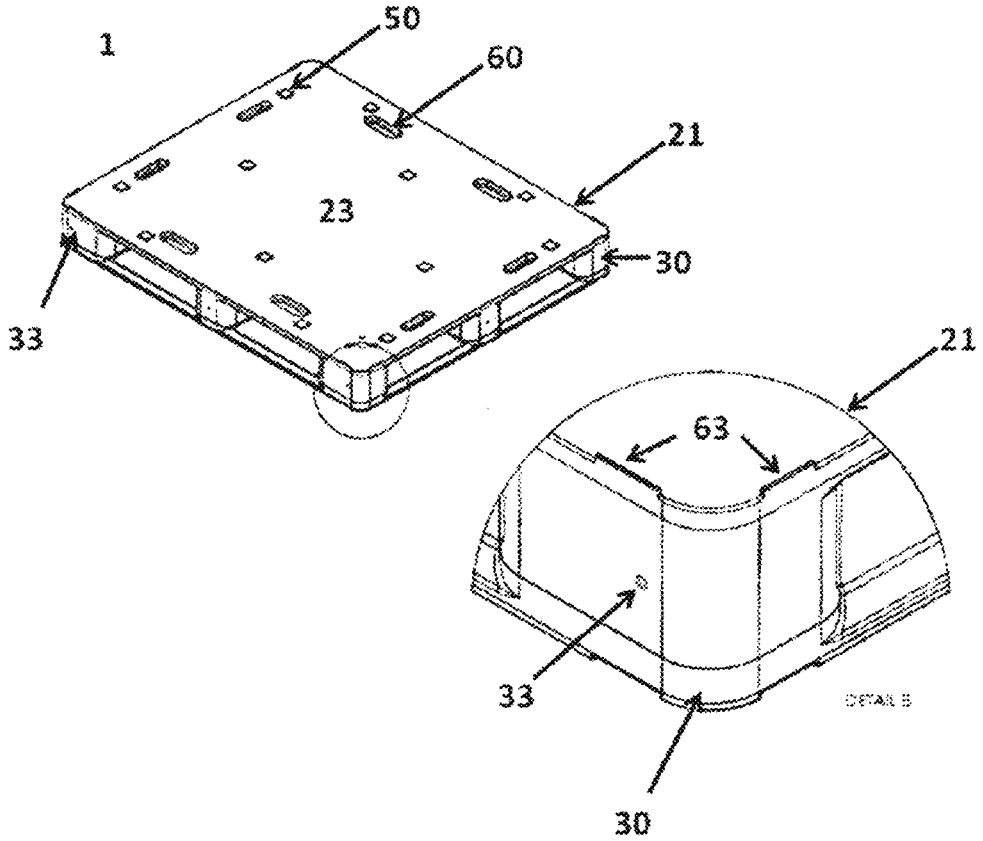
FIG. 8 shows a detailed view (E) of the nesting lips according to a preferred embodiment of the instant invention.
Figure 9:
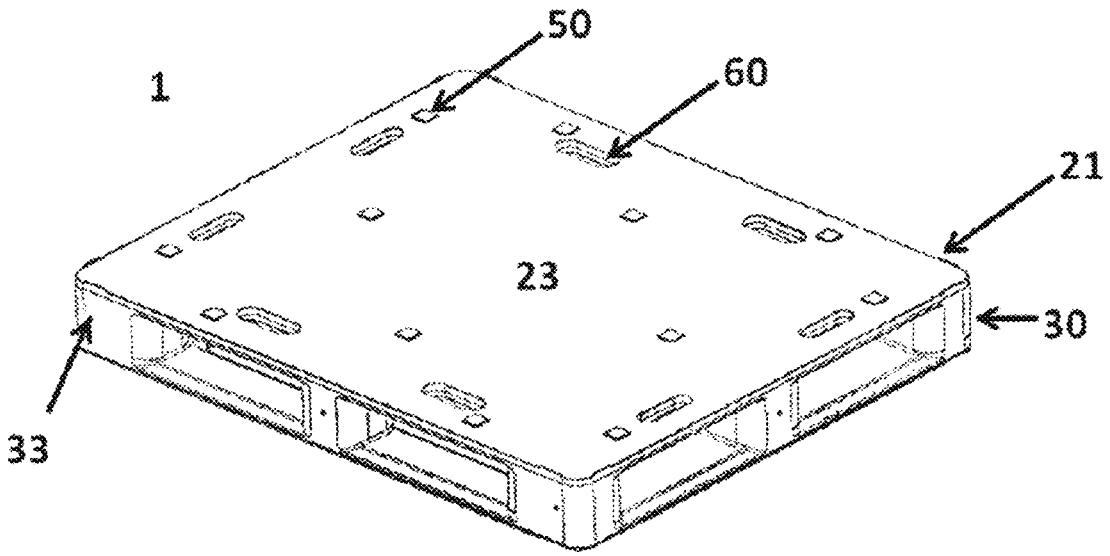
FIG. 9 shows a top frontal perspective view of the plastic pallet of the instant invention already assembled.
Figure 11:
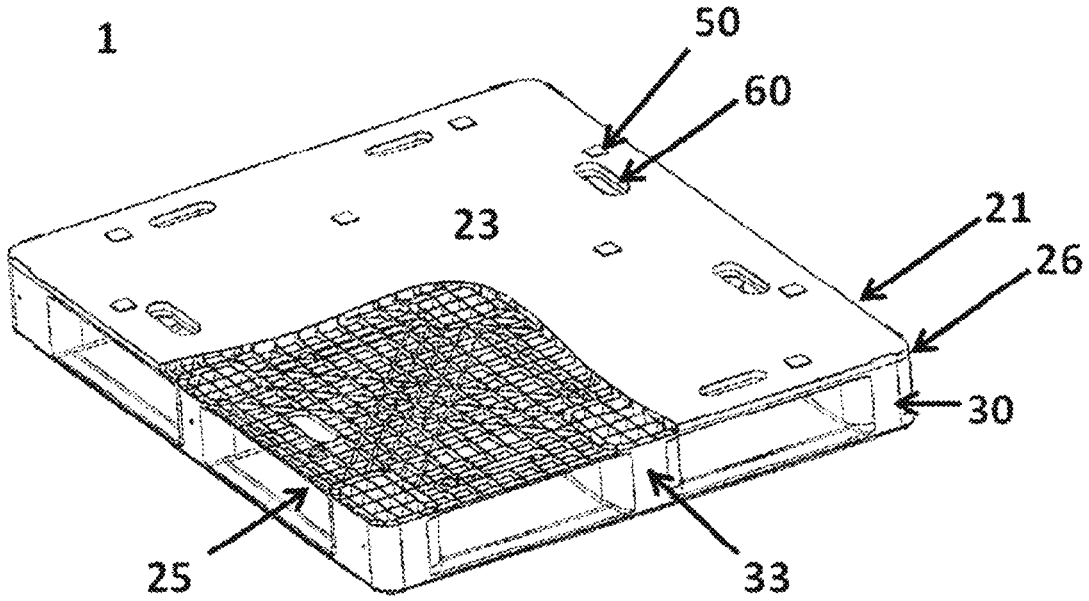
FIG. 11 shows a top frontal perspective view of the plastic pallet of the instant invention partially removing a detail of the top portion of the top deck.
Figure 12:
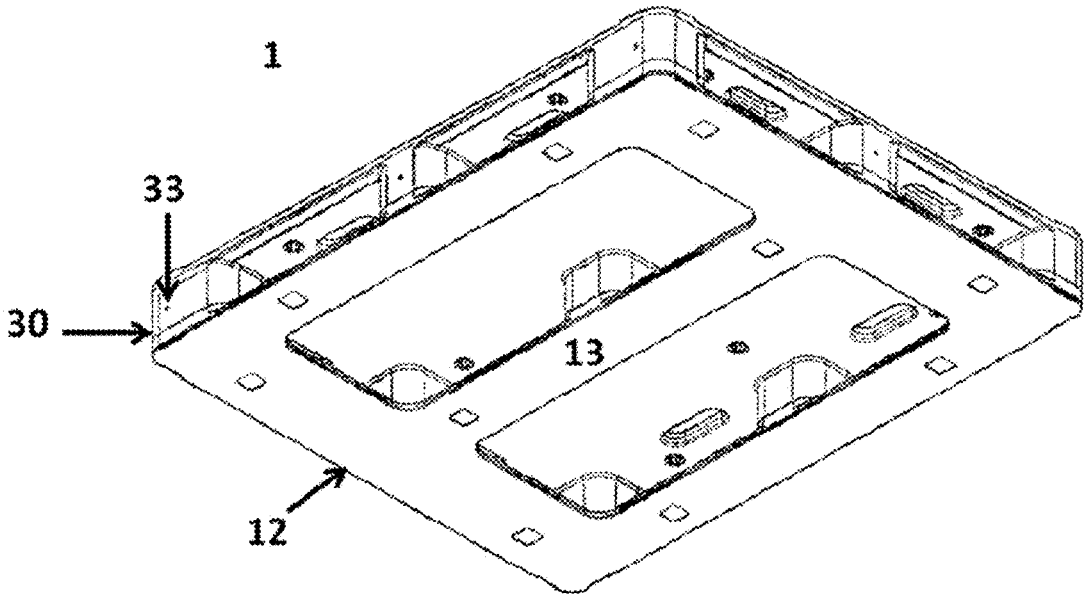
FIG. 12 shows a bottom frontal perspective view of the assembled plastic pallet of the instant invention.
Figure 13:
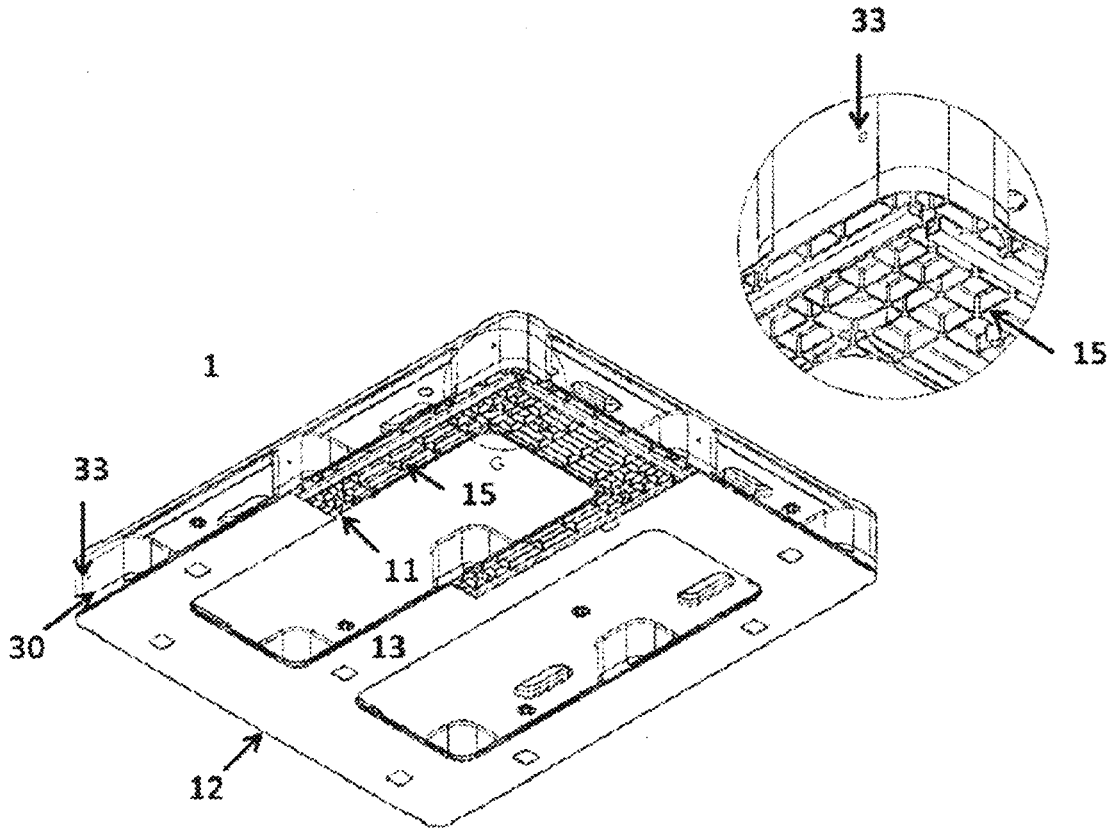
FIG. 13 shows a bottom frontal perspective view of the plastic pallet of the instant invention, partially removing the lower portion of the bottom deck and illustrating a detail (G) of the corner upper portion of the bottom deck.

Likewise, in a further embodiment of the invention, it is possible that in the top and bottom portions of the plastic pallet to arrange nesting lips (63) in the corners, as shown in FIG. 8.

In further embodiments of the instant invention, the material of the pallet can be rigidified by including a reinforced material such as fibers or mineral fillings.

EXPERIMENTAL RESULTS

The following table shows a summary of a Finite Element Analysis test carried out on a preferred embodiment of the instant invention.

For the FEA, the following load requirements were considered:

Static. 1,270 kg (2,800 lb) per pallet, at 5 stacks 6,350 kg (14,000 lb).

Racking. 1,270 kg (2,800 lb)

Dynamic. 2,540 kg (5,600 lb)

The following Material properties were used:

HDPE:

Young modulus 1,300 Mpa

Poisson's ratio 0.4

Yield strength 30 Mpa

Aluminum:

Young modulus 69,000 Mpa

Poisson's ratio 0.4

Yield strength 289 Mpa

Figure 20:
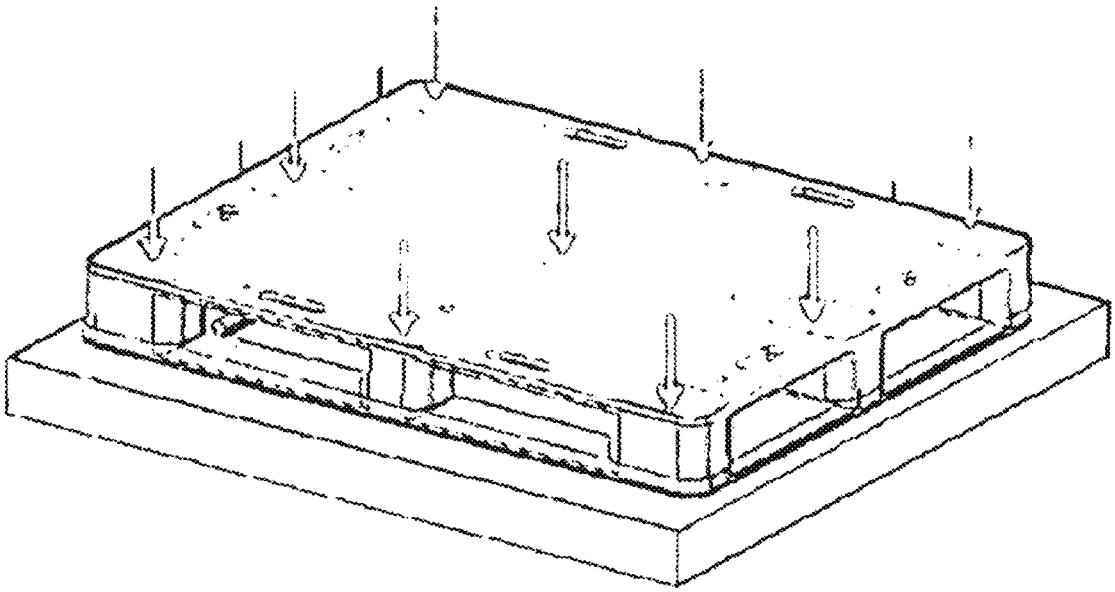
FIG. 20 shows the static load distribution on the top surface of the pallet during the FEA (Finite Element Analysis) test.

For static load, it is considered a load of 6,350 kg (14,000 lb) corresponding to 5 stacks of 2,800 lb (see FIG. 20).

Figure 21:
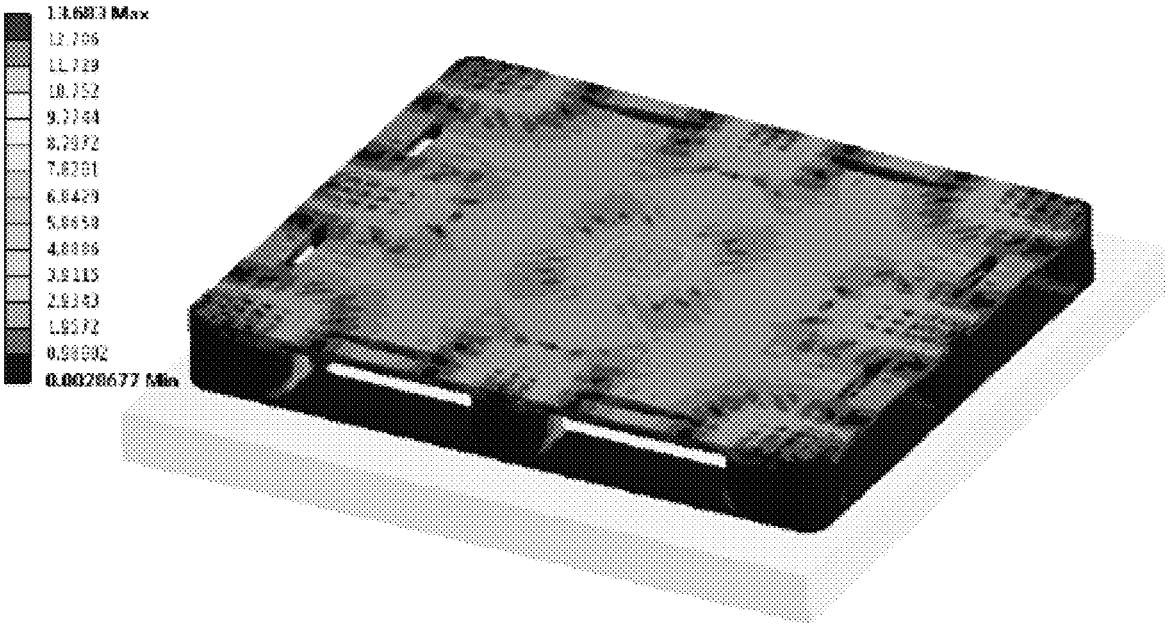
FIG. 21 shows a perspective view of the stress results on a pallet according to the instant invention during the FEA static load test.

The stress results can be observed in FIG. 21 wherein the total stress in the pallet product is shown.

Figure 22:
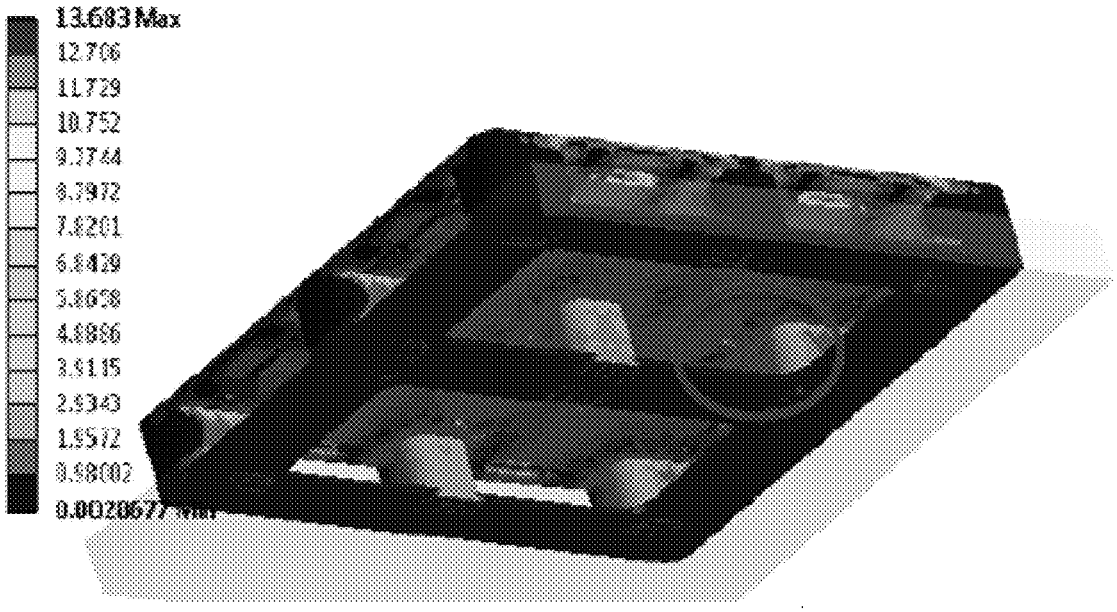
FIG. 22 shows the total stress in plastic on a pallet according to the instant invention during the FEA static load test.

Likewise, the total stress distribution in plastic of 13.68 MPa is shown in FIG. 22.

Figure 23:
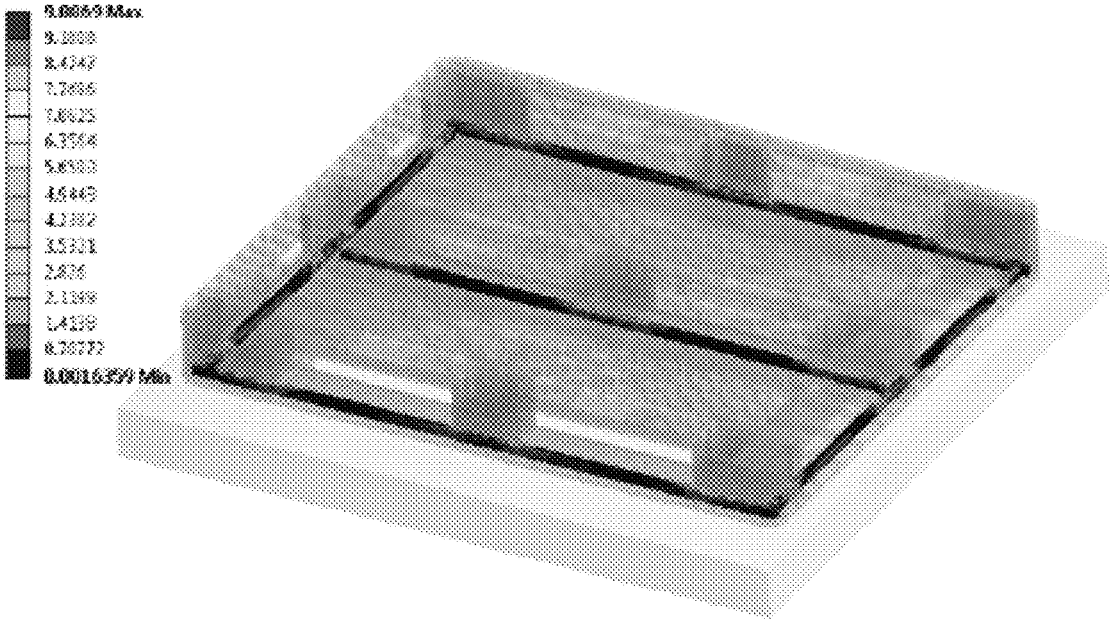
FIG. 23 shows the total stress in aluminum on a pallet according to the instant invention during the FEA static load test.

The total stress distribution in aluminum of 9.88 MPa is shown in FIG. 23.

Figure 24:
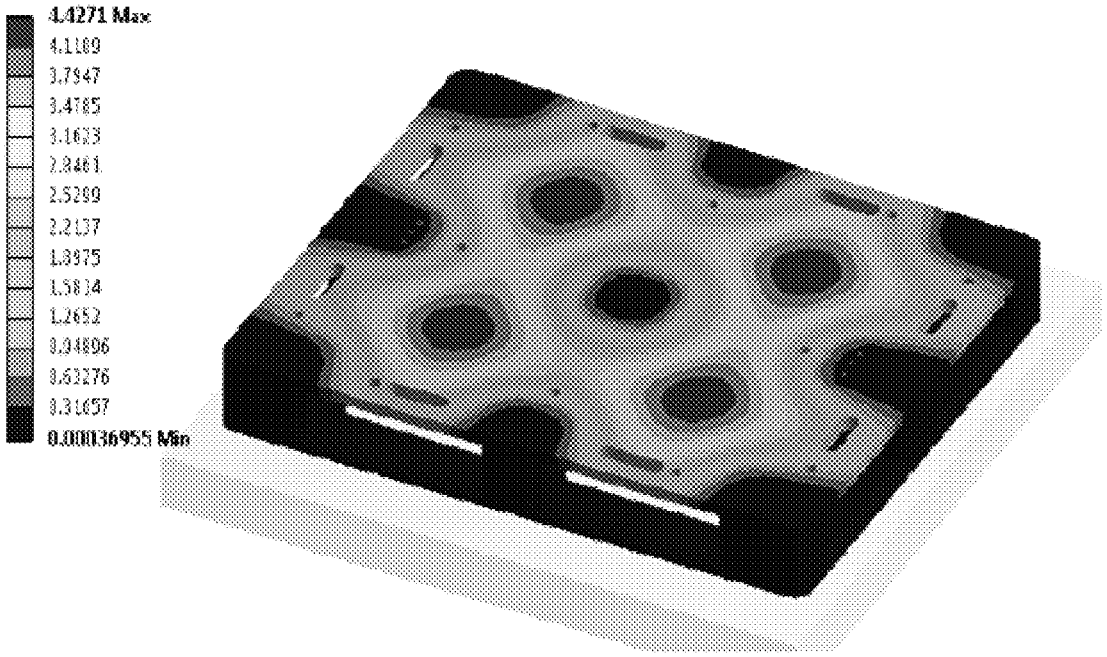
FIG. 24 shows the total displacement results on a pallet according to the instant invention during the FEA static load test.

The total displacement distribution of 4.42 mm is shown in FIG. 24.

Figure 25:
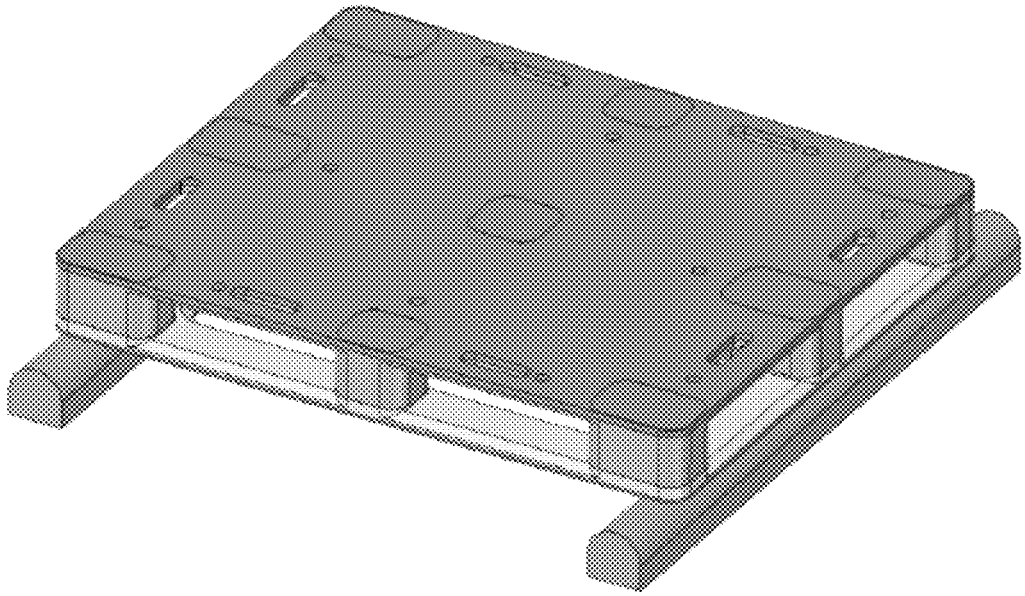
FIG. 25 shows the racking load distribution on the top surface of the pallet during the FEA test.

For racking, it is considered a load of 1,270 kg (2,800 lb) on the complete surface of the pallet uniformly distributed (see FIG. 25).

Figure 26:
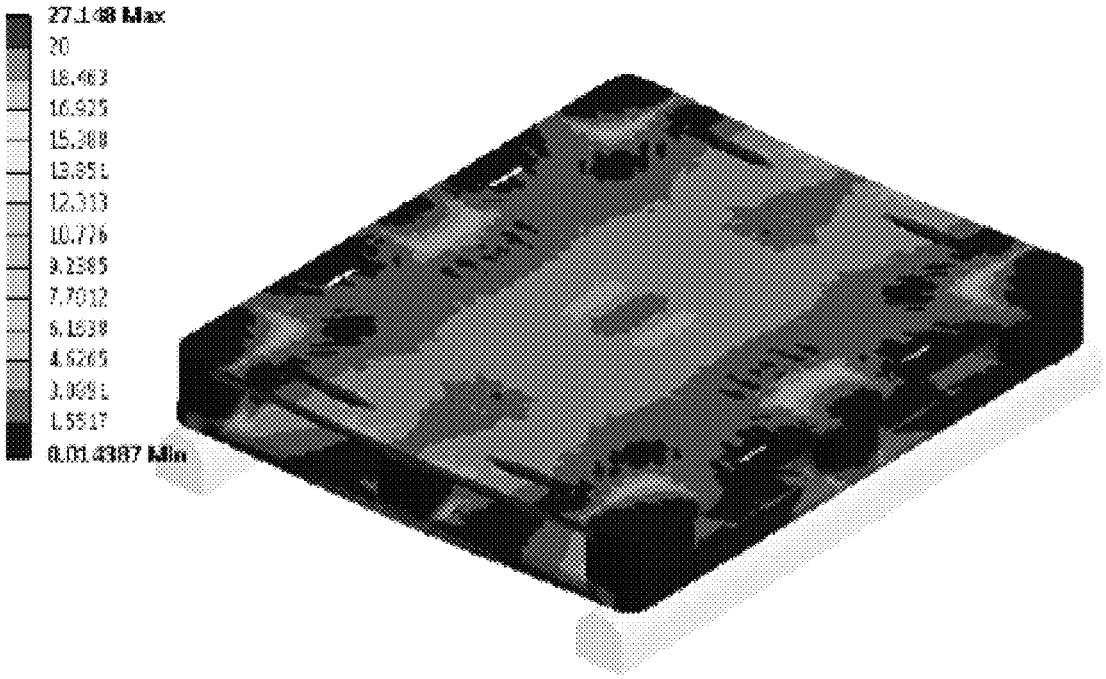
FIG. 26 shows a perspective view of the stress results on a pallet according to the instant invention during the FEA racking load test.

The stress results can be observed in FIG. 26 wherein the total stress in the pallet product is shown.

Figure 27:
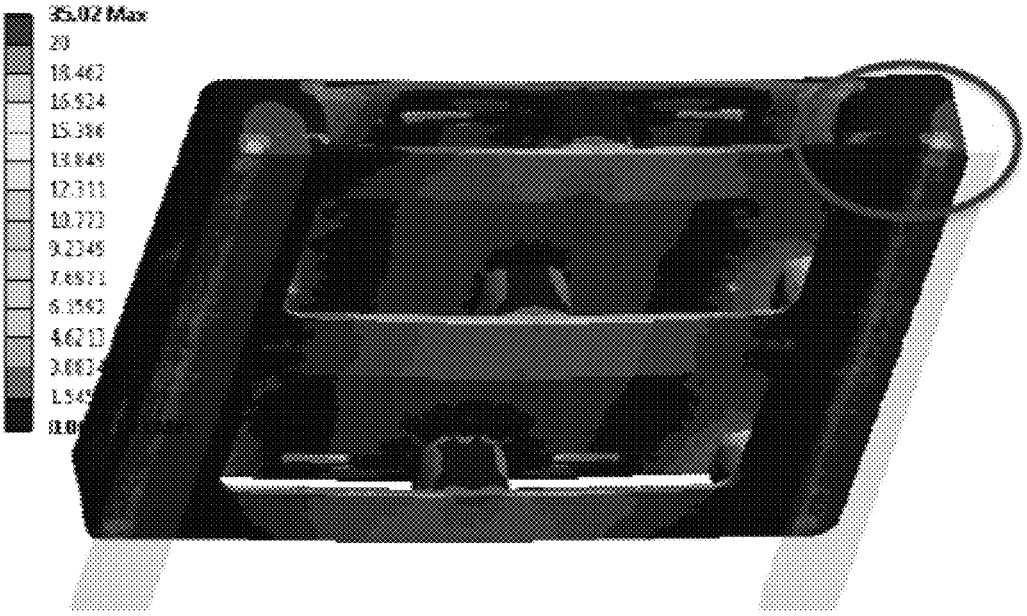
FIG. 27 shows the total stress in plastic on a pallet according to the instant invention during the FEA racking load test.

Likewise, the total stress distribution in plastic of 35.02 MPa is shown in FIG. 27.

Figure 28:
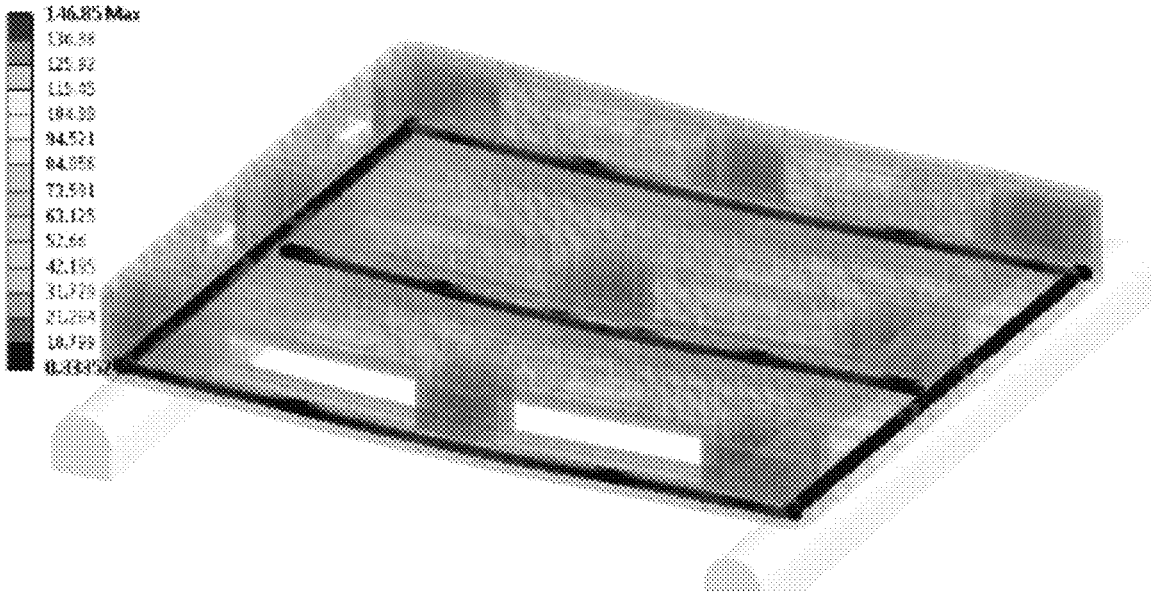
FIG. 28 shows the total stress in aluminum on a pallet according to the instant invention during the FEA racking load test.

The total stress distribution in aluminum of 146.85 MPa is shown in FIG. 28.

Figure 29:
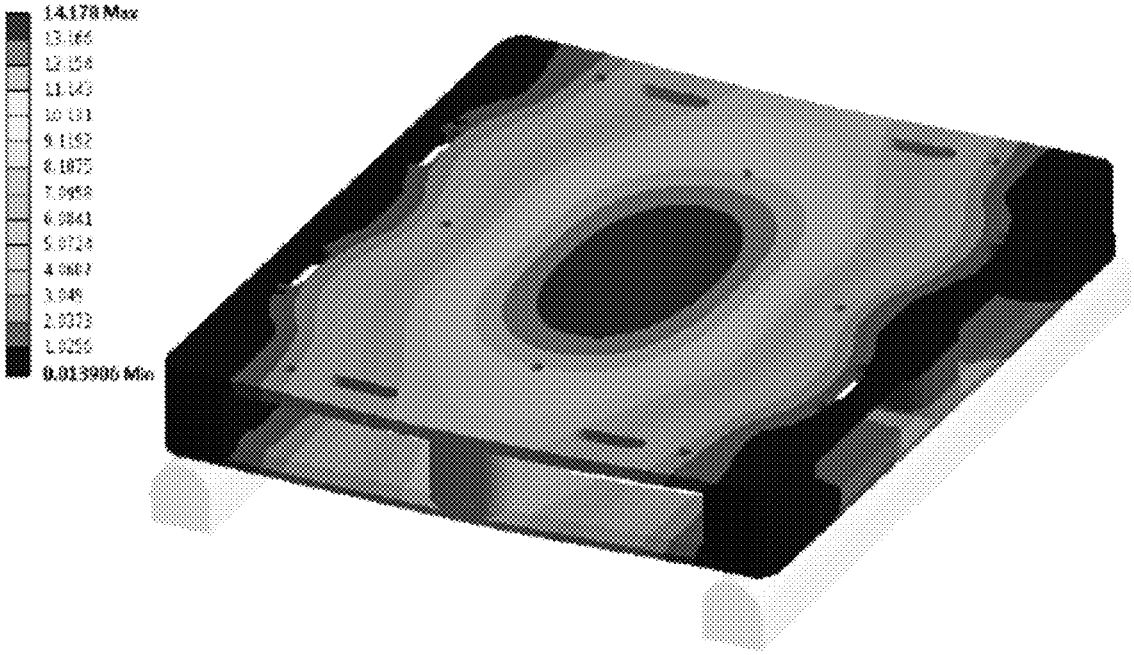
FIG. 29 shows the total displacement results on a pallet according to the instant invention during the FEA racking load test.

The total displacement distribution of 13.59 mm is shown in FIG. 29.

Figure 30:
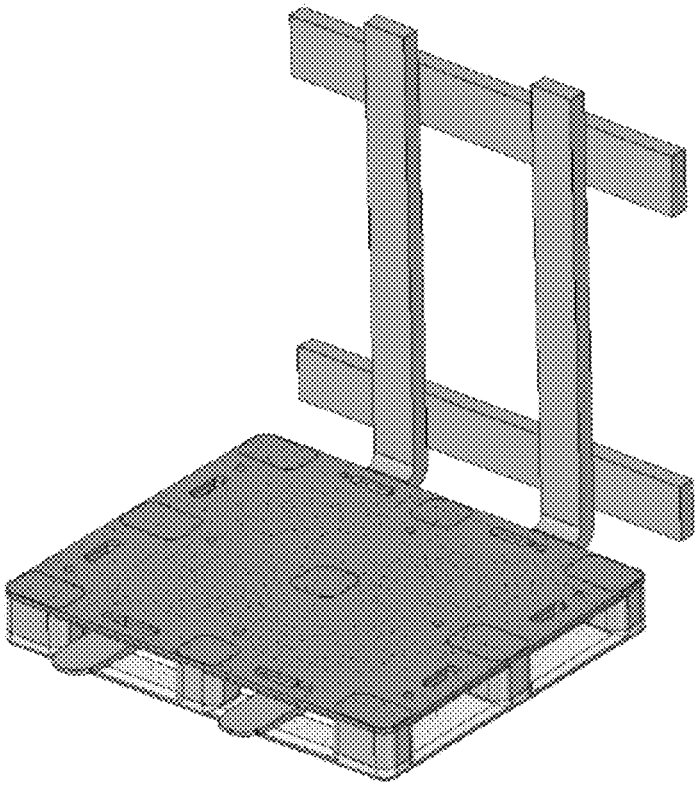
FIG. 30 shows the dynamic load distribution on the top surface of the pallet during the FEA test.

For dynamic, it is considered a load of 2,540 kg (5,600 lb) on the complete surface of the pallet uniformly distributed (see FIG. 30).

Figure 31:
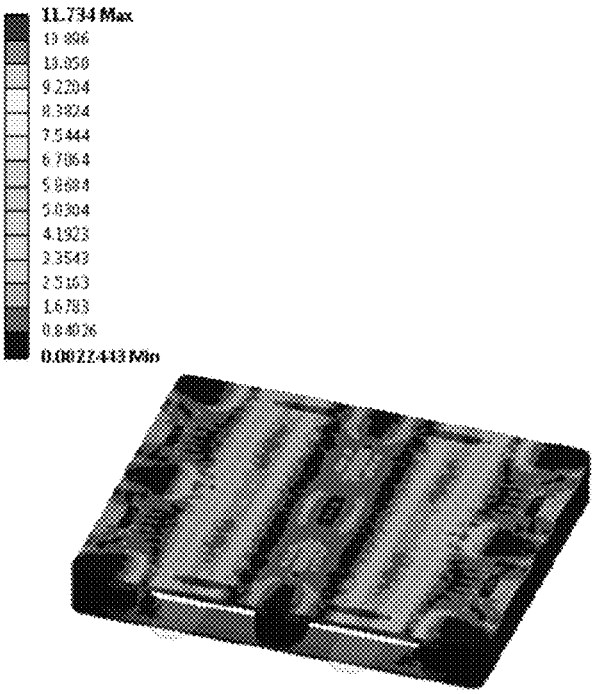
FIG. 31 shows the total stress in plastic on a pallet according to the instant invention during the FEA dynamic load test.

The total stress distribution in plastic of 11.73 MPa is shown in FIG. 31.

Figure 32:
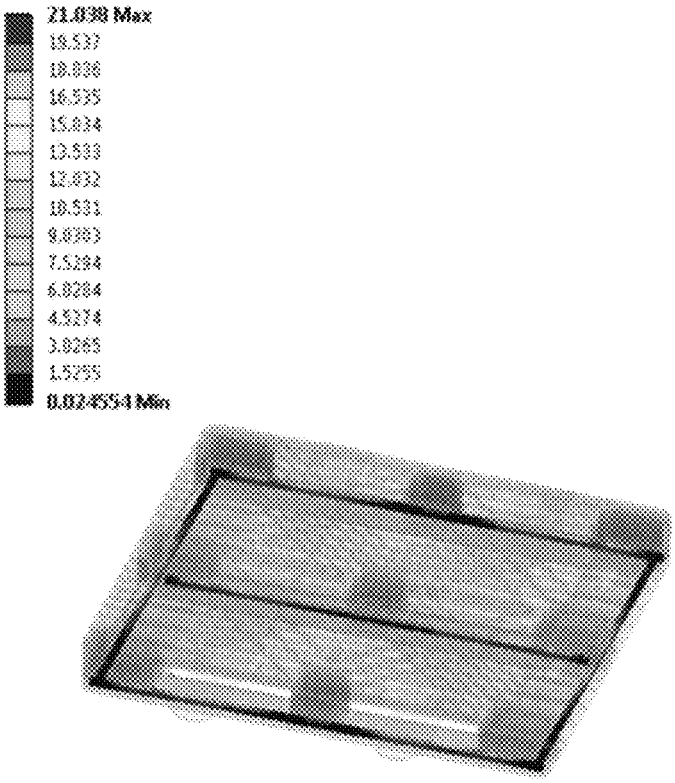
FIG. 32 shows the total stress in aluminum on a pallet according to the instant invention during the FEA dynamic load test.

The total stress distribution in aluminum of 21.03 MPa is shown in FIG. 32.

Figure 33:
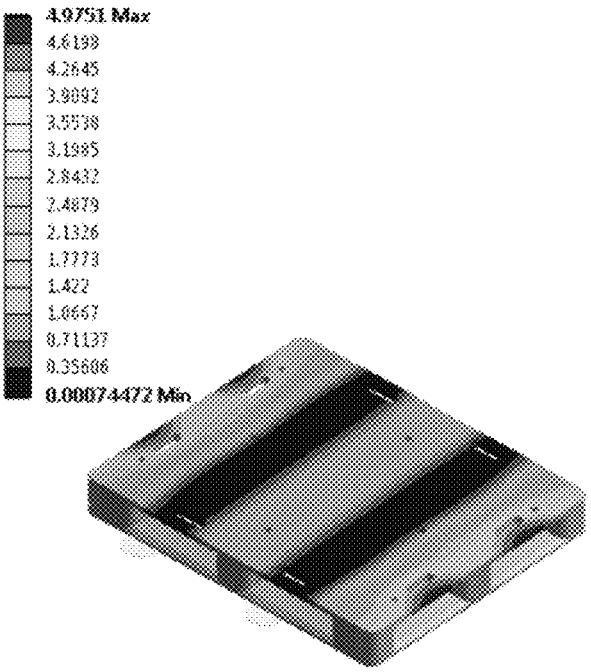
FIG. 33 shows the total displacement results on a pallet according to the instant invention during the FEA dynamic load test.

The total displacement distribution of 4.97 mm is shown in FIG. 33.

Figure 34:
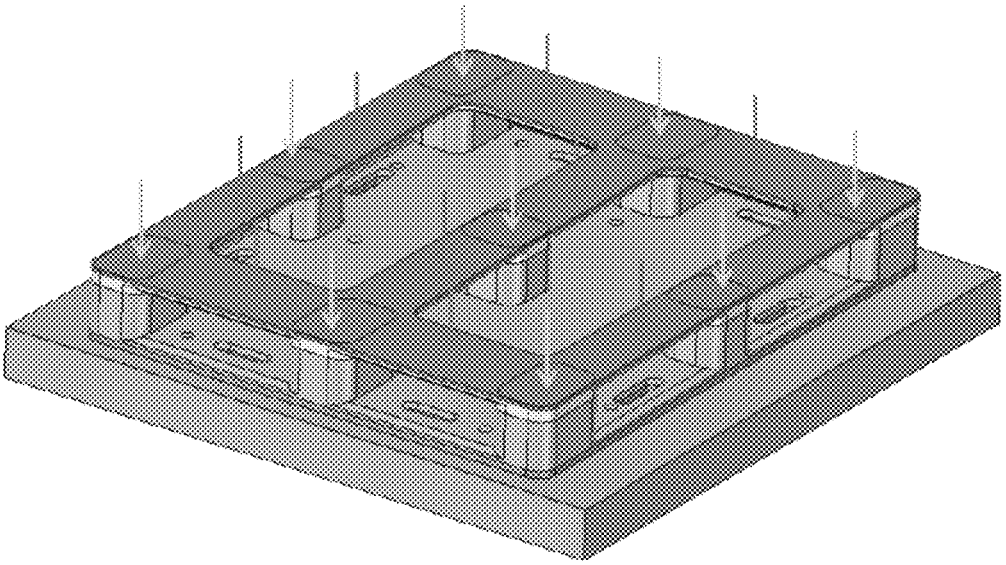
FIG. 34 shows the Inverted load distribution on the top surface of the pallet during the FEA test.

For inverted static load, it is considered a load of 5,080 kg (11,200 lb) corresponding to 4 stacks of 2,800 lb (see FIG. 34).

Figure 35:
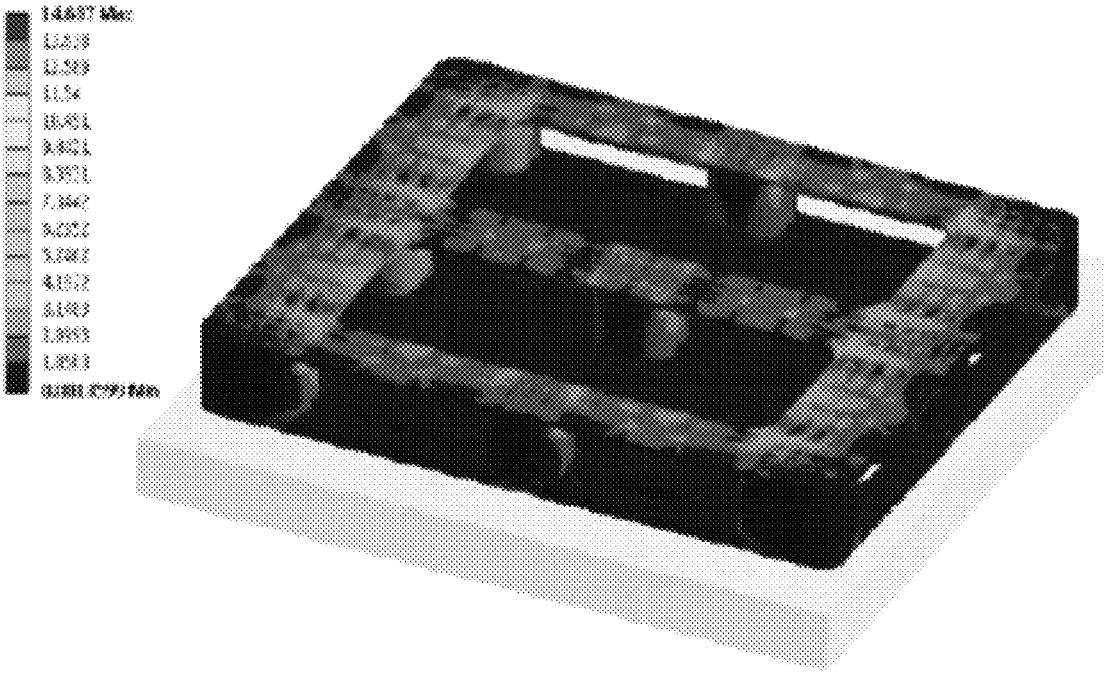
FIG. 35 shows the total stress in plastic on a pallet according to the instant invention during the FEA inverted load test.

The total stress distribution in plastic of 14.68 MPa is shown in FIG. 35.

Figure 36:
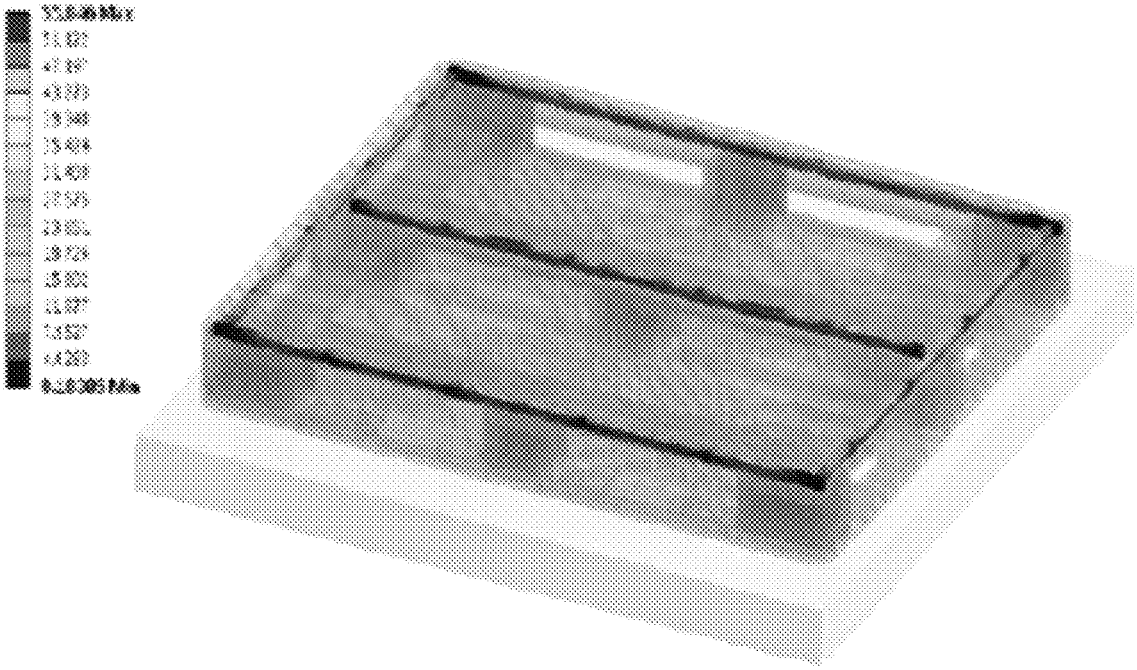
FIG. 36 shows the total stress in aluminum on a pallet according to the instant invention during the FEA inverted load test.

The total stress distribution in aluminum of 55.04 MPa is shown in FIG. 36.

Figure 37:
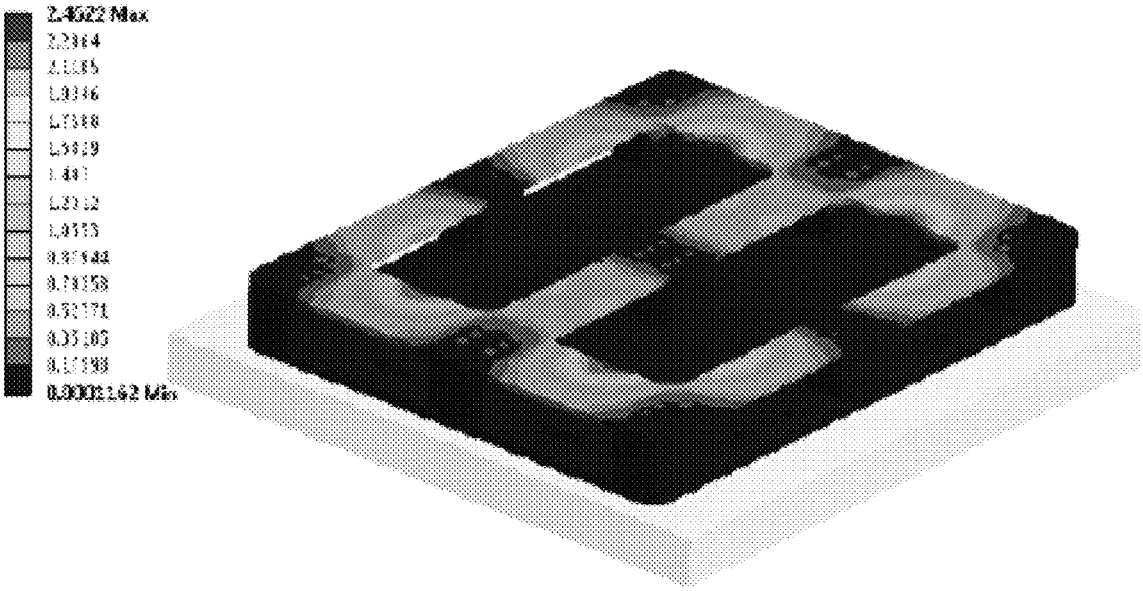
FIG. 37 shows the total displacement results on a pallet according to the instant invention during the FEA inverted load test.

The total displacement distribution of 2.46 mm is shown in FIG. 37.

LIST OF ELEMENTS

We provide herein below a list of the elements with its corresponding number:

| | |
|---|---|
| 1 | Plastic Pallet Assembly |
| 10 | Bottom deck |
| 11 | Upper portion of the bottom deck |
| 12 | Lower portion of the bottom deck |
| 13 | Smooth surface |
| 14 | Bottom deck rib arrangement |
| 20 | Top deck |
| 21 | Upper portion of the top deck |
| 23 | Top surface of the upper portion of the top deck |
| 25 | Top deck ribs and walls arrangement |
| 30 | Posts |
| 31 | Post cavity |
| 32 | Injected foam |
| 33 | Injection port |
| 40 | Reinforcement beams or inserts |
| 50 | Anti-slip rubbers |
| 60 | Hand holds |
| 61, 62 | Smooth surfaces |
| 63 | Nesting lips |

The invention claimed is:

1. A reinforced plastic pallet comprising:

a bottom portion, and a top portion, joined together having improved resistance to deformation caused by at least one of static, racking, or dynamic load;

wherein said bottom portion comprises a bottom deck and a bottom deck cover that are welded together;

wherein said top portion comprises a top deck and a top deck cover that are welded together;

wherein the top deck comprises a plurality of post portions;

wherein the top deck and the top deck cover, the bottom deck and the bottom deck cover are plane surfaces arranged in a sandwich structure;

wherein both plane surfaces are joined together by a rib arrangement;

wherein the rib arrangement in the top deck of the pallet comprises a plurality of square ribbing portions with each square ribbing portion positioned within the perimeter of each post portion and a plurality of diagonal ribs that are formed between the post portions, wherein the plurality of diagonal ribs cross through the square ribbing portions, wherein the plurality of diagonal ribs comprise a first diagonal rib portion and a second diagonal rib portion, wherein the first diagonal rib portion comprises a plurality of ribs extending parallel to each other between two square ribbing portions and the second diagonal rib portion comprises a plurality of ribs extending parallel to each other between two square ribbing portions;

wherein the square ribbing portions and the plurality of diagonal ribs are directly connected to the post portions in the top deck providing an improved rigidity to the area between the post portions; and wherein the sandwich structure, the square ribbing portions, and the plurality of diagonal ribs provide a reinforced plastic pallet with improved rigidity and strength to flexion of the plane surfaces and resistance to deformation.

2. The pallet according to claim 1, wherein a set of reinforcement beams is embedded between said bottom deck and said bottom deck cover.

3. The pallet according to claim 1, wherein the top portion comprises openings for receiving anti slip rubbers and integrated handholds.

4. The pallet according to claim 1, wherein the top and bottom portions comprise smooth surfaces.

5. The pallet according to claim 1, wherein an additional reinforcement beam is embedded into said top portion, between said top deck and said top deck cover.

6. The pallet according to claim 1, wherein no insert is used as reinforcement for the pallet.

7. The pallet according to claim 1, wherein each one of said plurality of post portions forms a cavity and includes at least one injection port.

8. The pallet according to claim 7, wherein the post portions are injected with a plastic foam filling the cavity formed in the post portions.

* * * * *